US010626583B2

(12) United States Patent
Mazz et al.

(10) Patent No.: US 10,626,583 B2
(45) Date of Patent: Apr. 21, 2020

(54) SHOWER CONTROL SYSTEM

(71) Applicant: Kohler Co., Kohler, WI (US)

(72) Inventors: Margaret C. Mazz, Sheboygan, WI (US); Gregory De Swarte, Sheboygan, WI (US); Donald P. Freier, Sheboygan, WI (US); Brian C. Wick, Sheboygan Falls, WI (US); Steven M. Tervo, Plymouth, WI (US); Jeffrey J. Mueller, Manitowoc, WI (US); Keith S. Ruh, Elkhart Lake, WI (US)

(73) Assignee: KOHLER CO., Kohler, WI (US)

( * ) Notice: Subject to any disclaimer, the term of this patent is extended or adjusted under 35 U.S.C. 154(b) by 537 days.

(21) Appl. No.: 14/610,296

(22) Filed: Jan. 30, 2015

(65) Prior Publication Data

US 2015/0218784 A1 Aug. 6, 2015

Related U.S. Application Data

(60) Provisional application No. 61/934,811, filed on Feb. 2, 2014.

(51) Int. Cl.
*E03C 1/05* (2006.01)
*E03C 1/04* (2006.01)
(Continued)

(52) U.S. Cl.
CPC ..... *E03C 1/055* (2013.01); *A47K 3/281* (2013.01); *A61H 33/005* (2013.01); *E03C 1/0408* (2013.01)

(58) Field of Classification Search
CPC ..... E03C 1/055; E03C 1/0408; A47K 3/281; A61H 33/005
(Continued)

(56) References Cited

U.S. PATENT DOCUMENTS 4,854,499 A 8/1989 Neuman
5,255,399 A 10/1993 Park
(Continued)

FOREIGN PATENT DOCUMENTS

CN 2162904 4/1994
CN 201150886 11/2008
(Continued)

OTHER PUBLICATIONS

International Search Report and Written Opinion for PCT/US2011/022787, dated Jun. 15, 2011, 10 pages.
(Continued)

*Primary Examiner* — Lori L Baker
(74) *Attorney, Agent, or Firm* — Foley & Lardner LLP

(57) ABSTRACT

A shower control system includes a controller in communication with a plurality of output devices located within a shower enclosure. The controller is configured to control the plurality of output devices. The shower control system further includes a control panel in communication with the controller and configured to provide a graphical user interface for controlling the plurality of output devices. The control panel includes an electronic display configured to present dynamic content, one or more static buttons, and a touch-sensitive panel overlaying both the electronic display and the one or more static buttons. The touch-sensitive panel is configured to detect a user interaction with both the one or more static buttons and the dynamic content presented via the electronic display.

9 Claims, 14 Drawing Sheets

(51) Int. Cl.
*A47K 3/28* (2006.01)
*A61H 33/00* (2006.01)

(58) Field of Classification Search
USPC ..... 4/597
See application file for complete search history.

(56) References Cited

U.S. PATENT DOCUMENTS

| | | | | |
|---|---|---|---|---|
| 5,414,879 | A | 5/1995 | Hiraishi et al. | |
| 7,756,590 | B2 * | 7/2010 | Debourke | E03C 1/041 700/19 |
| 8,267,328 | B2 * | 9/2012 | Pohl | E03C 1/055 137/607 |
| 8,627,850 | B1 | 1/2014 | Booker | |
| 8,769,733 | B2 * | 7/2014 | Galyean | A61H 33/00 4/601 |
| 2008/0259056 | A1 * | 10/2008 | Freier | G05D 23/1393 345/184 |
| 2008/0262755 | A1 | 10/2008 | Dayton et al. | |
| 2010/0271324 | A1 * | 10/2010 | Hayes | G06F 3/03547 345/173 |
| 2011/0186135 | A1 | 8/2011 | Hanna et al. | |
| 2011/0186136 | A1 | 8/2011 | Hanna et al. | |
| 2011/0186137 | A1 | 8/2011 | Hanna et al. | |
| 2011/0186138 | A1 * | 8/2011 | Hanna | E03C 1/05 137/1 |
| 2011/0285615 | A1 * | 11/2011 | Rayadurga | G09G 3/3426 345/102 |

FOREIGN PATENT DOCUMENTS

| | | | | |
|---|---|---|---|---|
| CN | 101799703 | A | 8/2010 | |
| CN | 103370481 | A | 10/2013 | |
| EP | 1657367 | A1 | 11/2005 | |
| EP | 1 640 837 | A2 | 3/2006 | |
| EP | 1792557 | A2 | 4/2006 | |
| IT | 1792557 | A2 * | 6/2007 | A47K 3/284 |
| TW | 191877 | | 10/1992 | |
| WO | WO-2006/058650 | | 6/2006 | |
| WO | WO 2011/094455 | A1 | 8/2011 | |

OTHER PUBLICATIONS

Taiwan Office Action and English Translation for Taiwan Patent Application No. 100104012, dated Jun. 26, 2013, 17 pages.
Taiwan Office Action and English Translation for Taiwan Patent Application No. 100104010, dated Jun. 20, 2013, 20 pages.
Notification of the First Office Action for Chinese Patent Application No. 201180022257 with English translation, dated Mar. 27, 2014, 15 pages.
English machine-translation of TW 191877 (Oct. 1, 1992) titled "Shower unit with automatic sprinkler function with multiple shower spout", 60 pages.
Taiwan Office Action and English Translation for Taiwan Patent Application No. 100103995, dated May 13, 2014, 10 pages.
Taiwan Office Action and English Translation for Taiwan Patent Application No. 100104011, dated May 9, 2014, 10 pages.
European Search Report dated Nov. 23, 2015 for Application No. 15176347.1, 7 pages.
Chinese Office Action and English translation issued in corresponding application No. 201510050042 dated Feb. 28, 2017, 21 pages.

* cited by examiner

SHOWER CONTROL SYSTEM

CROSS-REFERENCE TO RELATED PATENT APPLICATIONS

This application claims the benefit of and priority to U.S. Provisional Patent Application No. 61/934,811, filed Feb. 2, 2014, the entirety of which is incorporated by reference herein.

BACKGROUND

Showers have conventionally utilized mechanical user interface controls such as handles, knobs, selector switches, and the like. These mechanical user interface controls conventionally have a direct mechanical link to shower valves or other shower components. The mechanical user interface controls conventionally operate independently such that actuation of one control does not affect operation or actuation of another control.

It would be advantageous to provide an improved system for controlling various components of shower systems.

SUMMARY

One implementation of the present disclosure is shower control system. The shower control system includes a controller in communication with a plurality of output devices located within a shower enclosure. The controller is configured to control the plurality of output devices. The shower control system further includes a control panel in communication with the controller and configured to provide a graphical user interface for controlling the plurality of output devices. The control panel includes an electronic display configured to present dynamic content, one or more static buttons, and a touch-sensitive panel overlaying both the electronic display and the one or more static buttons. The touch-sensitive panel is configured to detect a user interaction with both the one or more static buttons and the dynamic content presented via the electronic display.

In some embodiments, the touch-sensitive panel includes a transparent portion through which the electronic display is visible and an opaque portion including one or more fixed-position optical apertures defining the one or more static buttons.

In some embodiments, the control panel includes a first backlight configured to provide backlighting for the electronic display and a second backlight configured to provide backlighting for one or more of the static buttons. The second backlight may include a discrete lighting element for each of the static buttons. Each of the discrete lighting elements may be independently controllable to illuminate one of the static buttons. In some embodiments, the control panel includes a light guide configured to direct light emitted from the second backlight toward a front surface of the control panel and through a fixed-position optical aperture in an opaque portion of the touch-sensitive panel. The light guide may include a discrete light guide element for each of the static buttons.

In some embodiments, the static buttons include a temperature up button and a temperature down button. The control panel may be configured to illuminate the temperature up button and the temperature down button when temperature adjustments are available. The control panel may be configured to de-illuminate the temperature up button and the temperature down button when temperature adjustments are not available.

In some embodiments, the plurality of output devices include a plurality of shower outlets. The static buttons may include a temperature up button and a temperature down button. The controller may use input received via the static buttons to adjust a temperature of water being dispensed from the plurality of shower outlets regardless of the dynamic content presented via the electronic display.

Another implementation of the present disclosure is another shower control system. The shower control system include a controller in communication with a plurality of output devices located within a shower enclosure. The controller is configured to control the plurality of output devices to provide a feature of the shower control system. The controller maintains first state information indicating which of the plurality of output devices are selected. The controller also maintains second state information indicating whether the feature is active. The controller uses the first state information and the second state information to determine whether to use each of the plurality of output devices to provide an output to the shower enclosure.

In some embodiments, the shower control system includes a control panel in communication with the controller and configured to provide a graphical user interface for controlling the feature of the shower control system. The graphical user interface may include a plurality of selectable icons representing the plurality of output devices. The controller may be configured to receive a user selection of one or more of the output devices via the graphical user interface and to update the first state information based on which of the output devices are selected via the graphical user interface.

In some embodiments, the control panel is configured to provide a graphical user interface for activating or deactivating the feature of the shower control system. The controller may be configured to activate or deactivate the feature of the shower control system and to update the second state information based on a user input received via the graphical user interface.

In some embodiments, determining whether to use an output device to provide an output to the shower enclosure includes using the first state information to determine whether the output device is selected, using the second state information to determine whether the output device is used in an active feature, and in response to a determination that the output device is both selected and used in an active feature, using the output device to provide an output to the shower enclosure in accordance with the active feature.

In some embodiments, the controller is configured to receive a user input indicating the selected output devices prior to activating any of the selected output devices. The controller may activate all of the selected output devices simultaneously upon activating a feature of the shower control system that uses all of the selected output devices.

In some embodiments, the controller is configured to run multiple active features of the shower control system concurrently and deactivate an active feature of the shower control system. In response to deactivating the active feature, the controller may deactivate each of the plurality of output devices that are used only in the deactivated feature of the shower control system. The controller may continue to operate each of the plurality of output devices that are used in any remaining active features of the shower control system in accordance with the remaining active features.

In some embodiments, the plurality of output devices include a plurality of shower outlets. The controller may be configured to determine that a purge feature of the shower control system is enabled and receive a user input selecting a new feature of the shower control system for activation. In response to the user input selecting the new feature for activation and prior to activating the new feature, the controller may temporarily activate all of the shower outlets until a temperature of water dispensed from the shower outlets reaches a threshold temperature. The controller may activate the new feature and operate the shower outlets in accordance with the new feature once the temperature of the water dispensed from the shower outlets reaches the threshold temperature.

Yet another implementation of the present disclosure is yet another shower control system. The shower control system includes a controller in communication with a plurality of output devices located within a shower enclosure. The controller is configured to control the plurality of output devices to provide a spa experience including a predetermined sequence of outputs from the plurality of output devices. The shower control system further includes a control panel in communication with the controller and configured to provide a graphical user interface for controlling the spa experience. The graphical user interface includes selectable options for adjusting a parameter of the spa experience while the plurality of output devices are providing the spa experience.

In some embodiments, the spa experience includes multiple timed segments. Each of the segments may include a different combination of outputs from the plurality of output devices. The selectable options for adjusting a parameter of the spa experience may include options for advancing to a next timed segment of the spa experience and returning to a previous timed segment of the spa experience.

In some embodiments, the selectable options for adjusting a parameter of the spa experience include options for adjusting a target temperature of water output by the plurality of output devices during a segment of the spa experience. In some embodiments, the graphical user interface is configured to display a pop-up temperature adjustment window in response to receiving a user input changing a target temperature of water output by the plurality of output devices.

In some embodiments, the graphical user interface is configured to display a temperature rising indicator when a temperature of water output by the plurality of output devices is increasing toward a target temperature. The graphical user interface may be configured to display a temperature falling indicator when the temperature of water output by the plurality of output devices is decreasing toward the target temperature.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, a shower and a shower control system are shown, according to an exemplary embodiment. The shower includes a shower enclosure and several shower subsystems (i.e., a water subsystem, an audio subsystem, a steam subsystem, a lighting subsystem, etc.). Each of the shower subsystems has output devices (e.g., shower outlets, flow control valves, temperature control valves, solenoids associated with the valves, lighting devices, audio output systems, steam outlets, etc.) configured to provide a user of the shower with an enhanced showering experience.

The shower control system includes a control panel having an electronic display. The electronic display is configured to display graphical user interfaces for allowing user control of the various shower subsystems and/or shower output devices. A controller is in communication with the electronic display and causes the graphical user interfaces to be presented via the electronic display. In various embodiments, the controller may be integrated with the control panel, physically separate from the control panel, or partially integrated and partially separate from the control panel. The control panel may include a touch-sensitive panel overlaying the electronic display (e.g., a capacitive touch screen), manually-operable buttons (e.g., capacitive touch buttons), and/or other user input devices configured to receive user input and provide the user input to the controller. The control panel (e.g., via the controller) controls the various components of the shower in response to the user inputs (e.g., signals or data representing the user inputs) received at the user input devices.

A shower control system is provided for receiving and processing user inputs, displaying a graphical user interface on the electronic display, and controlling outputs of the various output devices. The shower control system advantageously includes software that causes the generation and display of intuitive graphical user interfaces for providing an intuitive and powerful control experience to the user. Settings and combinations of settings may be saved in the shower control system (e.g., a controller of the system) for later playback (e.g., execution) by a controller of the shower control system. Such playback or execution causes actuation, adjustment, or another state change of one or a plurality of the shower output devices.

Figure 1:
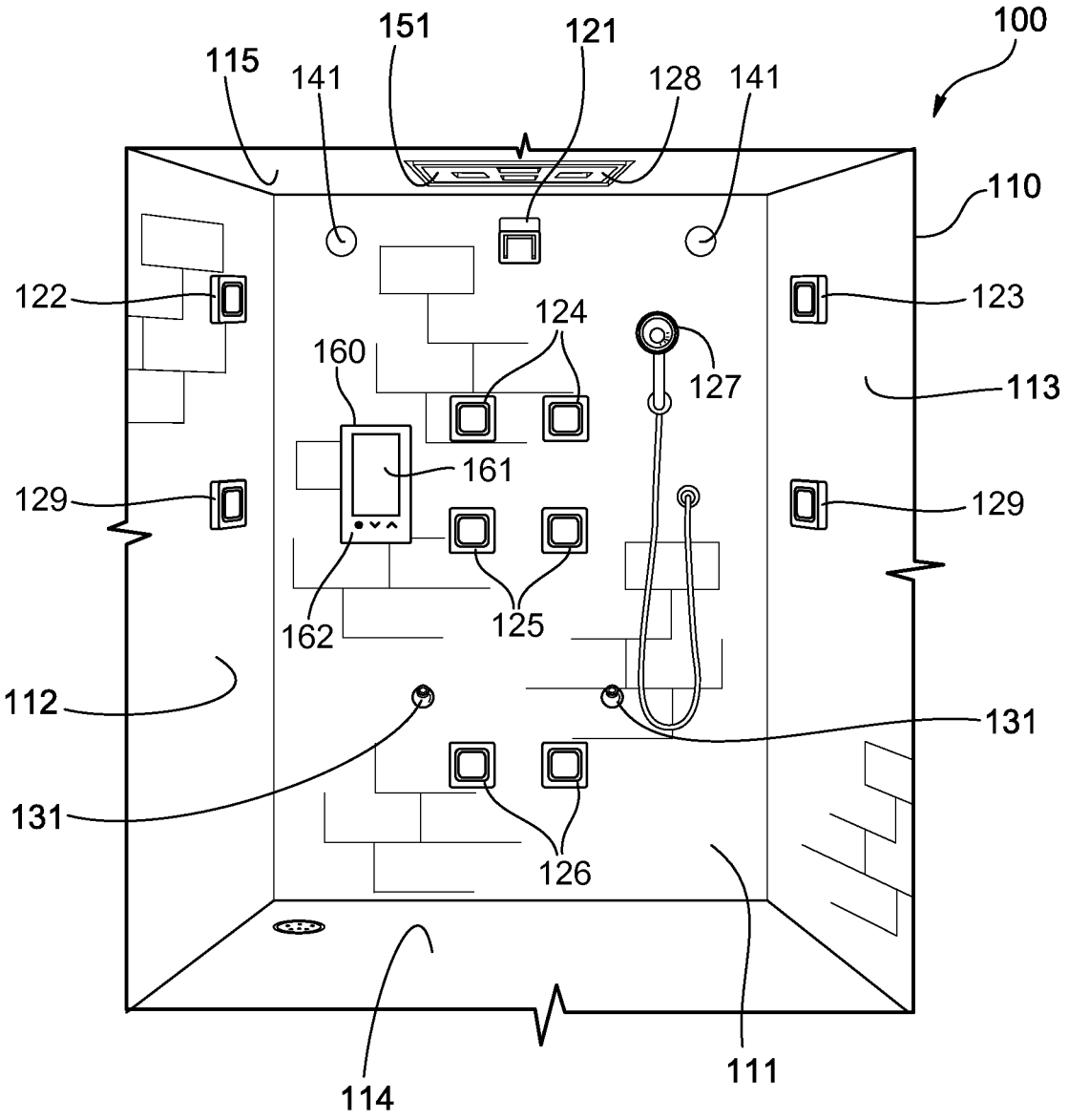
FIG. 1 is a drawing of a shower including a variety of output devices (e.g., shower outlets, speakers, lighting devices, and steam outlets) and a control panel positioned within a shower enclosure to facilitate user control over the various output devices, according to an exemplary embodiment.

Referring now to FIG. 1, a shower 100 is shown, according to an exemplary embodiment. Shower 100 includes a shower enclosure 110 having a front wall 111, left wall 112, right wall 113, floor 114, and ceiling 115. An access door may permit entry by the user into shower enclosure 110. The control systems and methods of the present disclosure may be used in combination with shower 100 or any other shower having any shape or size of shower enclosure. For example, alternative shower enclosures may contain fewer or additional walls, be of varying sizes, contain other water outlets or lighting arrangements, or be otherwise configured.

Shower 100 includes a water subsystem having various output devices (i.e., shower outlets) located within shower enclosure 110. For example, shower 100 is shown to include a front showerhead 121, a left showerhead 122, a right showerhead 123, an upper body spray 124, a middle body spray 125, a lower body spray 126, side body sprays 129, a handshower 127, and a rainhead 128. In various embodiments, the water subsystem or set of output devices may include any number or combinations of output devices. For example, in an alternative exemplary embodiment, water subsystem may include a central body spray (e.g., a vertical column of shower outlets) in place of upper body spray 124 and middle body spray 125. In another exemplary embodiment, left showerhead 122 and right showerhead 123 may be located on front wall 111. Shower outlets 121-129 may be located on any of surfaces 111-114 and may include additional or fewer shower outlets in various embodiments.

The water subsystem may include one or more analog or digital valves. Valves of the system may be configured to allow for an electronically controlled mixing of hot and cold water. Such mixing can allow control systems and methods described herein to achieve or approach certain target temperatures. Valves of the system may also be configured to allow for electronically controlled or selected shower outlet water flow. The electronically controlled valves (e.g., solenoids for actuating the hydraulic valves) are controlled via control signals from one or more controllers of the shower control systems described throughout this disclosure. The valves may be used to independently control flow volume to each of shower outlets 121-129.

In some embodiments, the water subsystem includes multiple different temperature control valves (e.g., thermostatic valves). Each temperature control valve may have a plurality of outlet ports (e.g., three outlet ports, six outlet ports, etc.). A first temperature control valve may control the temperature of water provided to a first subset of shower outlets 121-129 and a second temperature control valve may control the temperature of water provided to a second subset of shower outlets 121-129. For example, a first temperature control valve may control the temperature of water provided to shower outlets 121, 125, and 128, whereas a second temperature control valve may control the temperature of water provided to shower outlets 122, 123, 124, 126, and 127. Advantageously, using multiple different temperature control valves allows the water from different shower outlets to have different temperatures. In other embodiments, a single temperature control valve is used to control the temperature of water provided to the various shower outlets. In various embodiments, any number of temperature control valves may be used to define any number of temperature zones.

In some embodiments, shower 100 includes a steam subsystem. The steam subsystem includes steam outlets 131 that receive steam from a steam generator in fluid communication with steam outlets 131. The steam generator is disposed between, and coupled via conduit (e.g., piping or tubing), to steam outlets 131 and a water supply. The steam generator heats the water, turning it into steam that is then communicated into shower enclosure 110 through steam outlets 131. The steam generator are controlled via control signals from one or more controllers of the shower control systems described throughout this disclosure.

In some embodiments, shower 100 includes a music subsystem. The music subsystem includes speakers 141, an amplifier, and a media player. The amplifier, media player, and other components may be located proximate to or remote from shower enclosure 110. The music subsystem is configured to communicate sound into shower enclosure 110. The music subsystem (e.g., a media player thereof) may be controlled via control signals from one or more controllers of the shower control systems described throughout this disclosure.

In some embodiments, shower 100 includes a lighting subsystem. The lighting subsystem includes one or more lights 151, such as conventional light bulbs (e.g., incandescent, LED, fluorescent) or a plurality of colored lights configured for use as a lighted rain panel used for chromatherapy. In some embodiments, lights 151 are integrated with rainhead 128. The lighting subsystem is configured to selectively supply light into shower enclosure 110. The lighting subsystem (e.g., particular switches for the lights, dimmers for the lights, etc.) may be controlled via control signals from one or more controllers of the shower control systems described throughout this disclosure.

In some embodiments, a control panel 160 is configured to receive user inputs for controlling the shower subsystems and for communicating settings and status information of the shower subsystems to a user. Control panel 160 generally includes a housing and an electronic display 161 (e.g., a LCD panel). The housing includes various attachment points (e.g., brackets, fasteners, portions for receiving screw heads, etc.) for mounting control panel 160 within shower enclosure 110. The housing also provides a waterproof casing to protect electronic display 161 and associated internal electronic components from moisture. A touch-sensitive panel (e.g., a capacitive touch panel) may also be provided on the housing for receiving user inputs. A portion of the touch-sensitive panel may overlay electronic display 161 to provide a touchscreen interface. Electronic display 161 can be caused to display graphical user interfaces and to receive user inputs via the touch screen interface.

In some embodiments, another portion of the touch-sensitive panel (or a different touch-sensitive panel) overlays one or more illuminated buttons 162 that are not part of electronic display 161. Buttons 162 may be backlit (e.g., by a LED) using a separate lighting source. Buttons 162 may be touch sensitive (e.g., capacitive touch) or a group of hard keys (e.g., physical buttons). Buttons 162 may be static buttons which are selectively illuminated by activating or deactivating the backlighting for each button. In some embodiments, the same touch-sensitive panel overlays both electronic display 161 and buttons 162.

Figure 2:
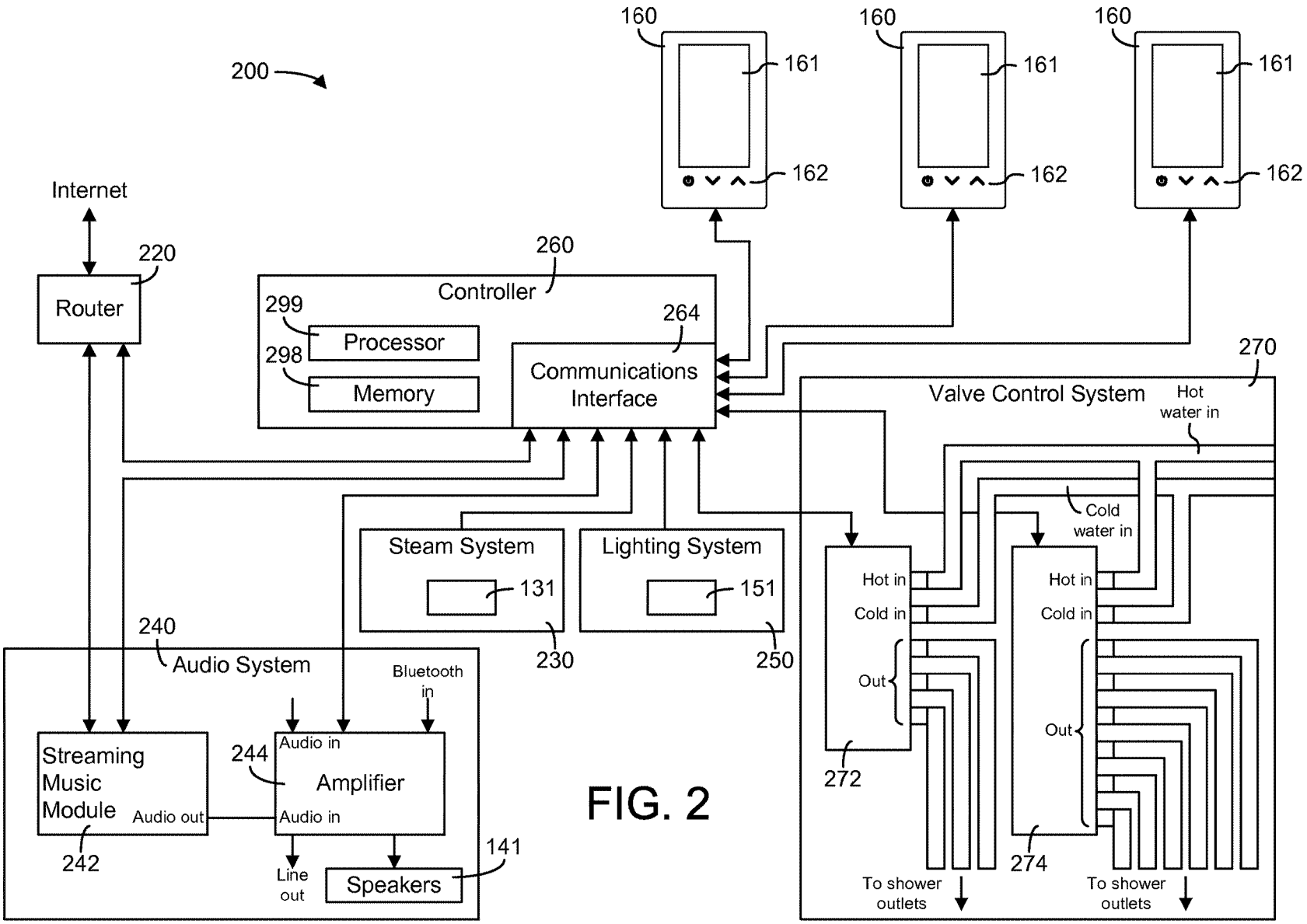
FIG. 2 is a block diagram of a shower control system including a controller in communication with a control panel, an audio system, a steam system, a lighting system, and a valve control system, which may be used to monitor and control the various components of the shower of FIG. 1, according to an exemplary embodiment.

Referring now to FIG. 2, a block diagram of a shower control system 200 is shown, according to an exemplary embodiment. Shower control system 200 generally refers to the electronics involved in processing and communicating signals for controlling shower subsystems 230-270 according to user inputs, but may also refer to any of the controlled shower subsystems 230-270 or shower output devices themselves. Shower control system 200 receives indications to change conditions of the various output devices (e.g., from the user input devices) and acts upon the indications by sending signals to control panels 160, shower subsystems 230-270, and/or devices/controllers thereof.

Shower control system 200 includes a controller 260 in communication with one or more control panels 160. Each of control panels 160 may be disposed at a different location (e.g., in shower 100, outside shower 100, etc.) for facilitating user interaction with shower control system 200 at multiple different locations. In various embodiments, controller 260 may be integrated with one or more of control panels 160 or separate from control panels 160. Controller 260 may receive input from control panels 160 (e.g., via communications interface 264) and may control the user interface outputs provided via electronic display 161. Controller 260 processes user inputs received at control panels 160 (e.g., user inputs received via a touchscreen, buttons, switches, or other user input devices of control panel 160) and provides control outputs to shower subsystems 230-270 based on the user inputs.

Controller 260 communicates with shower subsystems 230-270 and/or the devices thereof (e.g., shower outlets, speakers, lights, valves, etc.) for controlling the various output devices. For example, controller 260 may receive an indication to adjust the temperature of the water provided by one or more of shower outlets 121-129 (e.g., based on user input received at a touch panel interface), and act upon the indication by causing water with increased temperature to flow through the shower outlet (e.g., by sending an appropriate control signal to the appropriate mixing valve subsystem). Controller 260 may cause electronic display 161 to indicate a target water temperature, an actual water temperature, and indication of whether the actual water temperature is rising or falling. Controller 260 may cause electronic display 161 to indicate the requested and completed adjustment in temperature.

In some embodiments, controller 260 is configured to receive signals from control panels 160, steam system 230, audio system 240, lighting system 250, valve control system 270 (e.g., electronic valves 272-274), and/or other subsystems or devices of shower control system 200 or external devices (e.g., router 220). Controller 260 processes and acts upon the received signals. Controller 260 may act upon signals received by sending control signals to steam system 230, audio system 240, and lighting system 250. Controller 260 may also act upon signals received by sending control signals to valve control system 270 (e.g., electronic valves 272-274) or other shower subsystem components.

Controller 260 is shown to include a communications interface 264, a processor 299, and memory 298. Communications interface 264 may include wired or wireless interfaces (e.g., jacks, antennas, transmitters, receivers, transceivers, wire terminals, etc.) for conducting data communications with various systems, devices, or networks. For example, communications interface 264 can include an Ethernet card and port for sending and receiving data via an Ethernet-based communications network and/or a WiFi transceiver for communicating via a wireless communications network. Communications interface 264 may be configured to communicate via local area networks (e.g., a home network, a LAN, etc.) or wide area networks (e.g., the Internet, a WAN, etc.).

Processor 299 may be a general purpose or specific purpose processor, an application specific integrated circuit (ASIC), one or more programmable logic controllers (PLCs), one or more field programmable gate arrays (FPGAs), a group of processing components, or other suitable processing components. Processor 299 is configured to execute computer code or instructions stored in memory 298 or received from other computer readable media (e.g., embedded flash memory, local hard disk storage, local ROM, network storage, a remote server, etc.).

Memory 298 may include one or more devices (e.g., memory units, memory devices, storage devices, etc.) for storing data and/or computer code for completing and/or facilitating the various processes described in the present disclosure. Memory 298 may include random access memory (RAM), read-only memory (ROM), hard drive storage, temporary storage, non-volatile memory, flash memory, optical memory, or any other suitable memory for storing software objects and/or computer instructions. Memory 298 may include database components, object code components, script components, or any other type of information structure for supporting the various activities and information structures described in the present disclosure. Memory 298 may be communicably connected to processor 299 via a processing circuit and may include computer code for executing (e.g., by processor 299) one or more processes described herein. For example, memory 298 may include graphics, web pages, HTML files, XML files, script code, shower configuration files, or other resources for use in generating graphical user interfaces for display and/or for use in interpreting user interface inputs to make command, control, or communication decisions. In some embodiments, memory 298 includes a valve control module, a steam control module, a lighting control module, an audio control module, a user interface module, and/or other modules configured to facilitate user control of shower subsystems 230-270 and the various components thereof.

Still referring to FIG. 2, shower control system 200 is shown to include a valve control system 270. According to an exemplary embodiment, one or more digital valves 272-274 are configured to selectively mix hot and cold water and selectively control water output to shower outlets 121-129. Each digital valve 272-274 may be arranged between shower outlets 121-129 and hot and cold water supplies. In an exemplary embodiment, valves 272-274 include a thermostatic mixing component (e.g., for controlling temperature) and/or one or more electrically-actuated solenoids (e.g., for controlling flow volume). In some embodiments, valve control system 270 includes one or more sensors for measuring temperature, valve position, and/or water pressure upstream or downstream of valves 272-274. The sensors may send signals with condition information to controller 260, which then processes the signals, and acts upon them.

Valves 272-274 may be electrically operated. In some embodiments, controller 260 controls operation of valves 272-274. Controller 260 may operate each of valves 272-274 independently to achieve multiple different water temperatures simultaneously. For example, controller 260 may cause valve 272 to output water having a first temperature and may cause valve 274 to output water having a second temperature, different from the first temperature.

In some embodiments, the hot and cold water inlets of valves 272-274 are coupled via a conduit (e.g., piping or tubing) to hot and cold water supplies, respectively. Valves 272-274 may be actuated by controller 260 and/or a separate valve driver circuit. Valves 272-274 may be configured to control an amount of hot and cold water allowed to pass through valves 272-274 to achieve a specified water temperature. Each of valves 272-274 may be independently connected to the hot and cold water supplies and may be operated independently to control the temperature of the water provided to a subset of shower outlets 121-129.

In some embodiments, each of valves 272-274 is connected (e.g., via piping or tubing) to one or more of shower outlets 121-129. Valves 272-274 may be actuated by controller 260 and/or a separate valve driver circuit to selectively open and close to control an amount of water (e.g., a flow rate) provided to each of shower outlets 121-129. Valve 272 is shown to include three outlet ports and valve 274 is shown to include six outlet ports. Each of the outlet ports may be opened and closed independently (e.g., via a solenoid or outlet valve) to independently control the flow rate of water provided to each of shower outlets 121-129.

In some embodiments, valves 272-274 do not include outlet valves. Instead, outlet valves may be disposed between valves 272-274 and shower outlets 121-129, may be attached directly to shower outlets 121-129, or may be integral with shower outlets 121-129. According to another exemplary embodiment, valves 272-274 are attached directly to or are integral with shower outlets 121-129, eliminating the need for outlet valves.

Still referring to FIG. 2, shower control system 200 is shown to include a steam system 230, an audio system 240, and a lighting system 250. In some embodiments, the control electronics (e.g., controller, microprocessor, data interface) for one or more of subsystems 230-250 may be integral with each other and/or combined with controller 260. For example, controller 260 may include the control electronics for lighting system 250, audio system 240, and/or other subsystems of shower control system 200, thus obviating the need for separate system control electronics. In other embodiments, each subsystem may include a controller and data interface that is configured for receiving signals, processing those signals, and acting upon received signals. Steam system 230, audio system 240, and/or lighting system 250 may include sensors for detecting conditions of the respective systems, such as temperature, humidity, volume, and luminosity.

Figure 3:
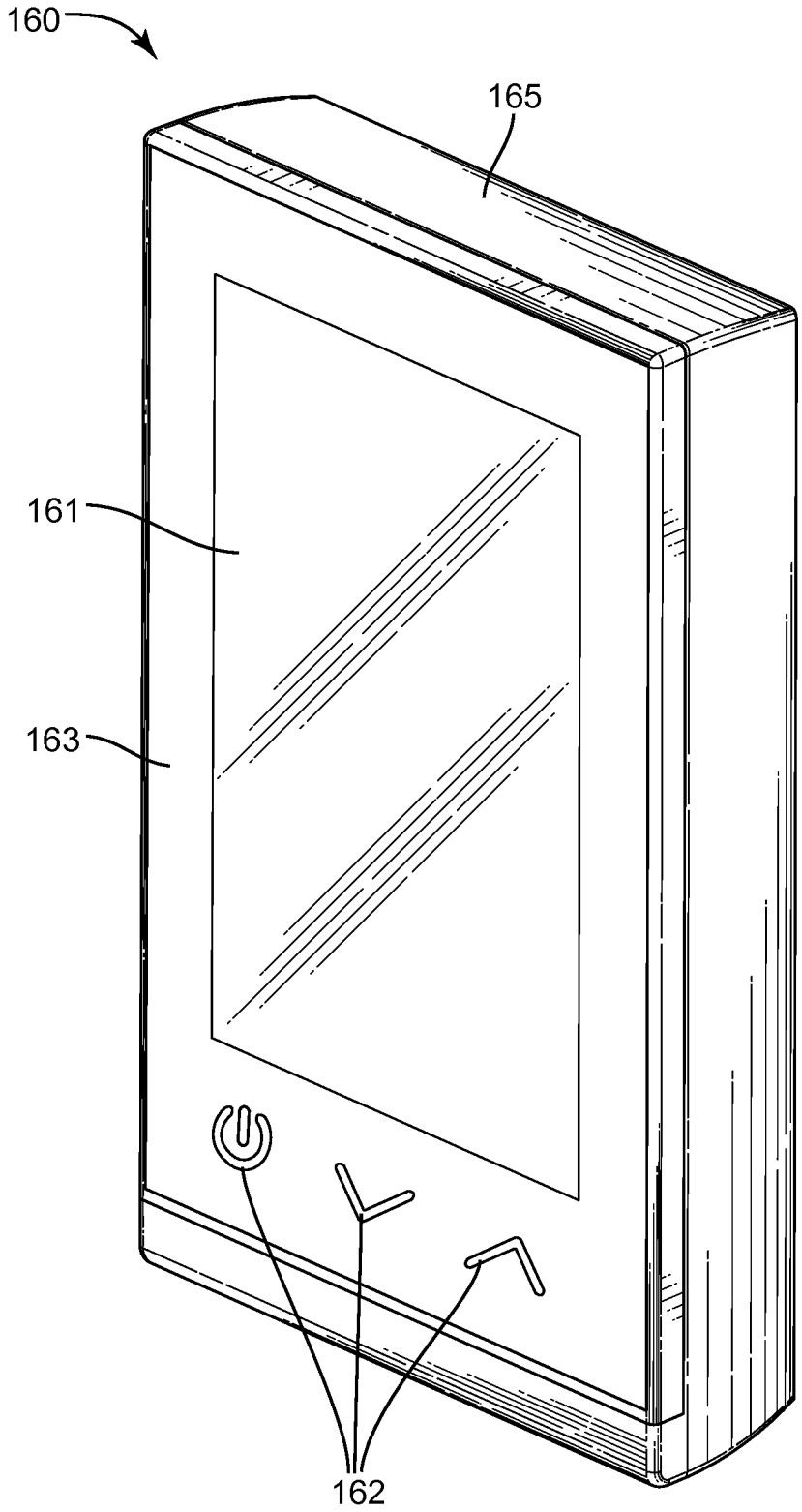
FIG. 3 is a drawing illustrating the control panel of FIGS. 1-2 in greater detail, according to an exemplary embodiment.
Figure 4:
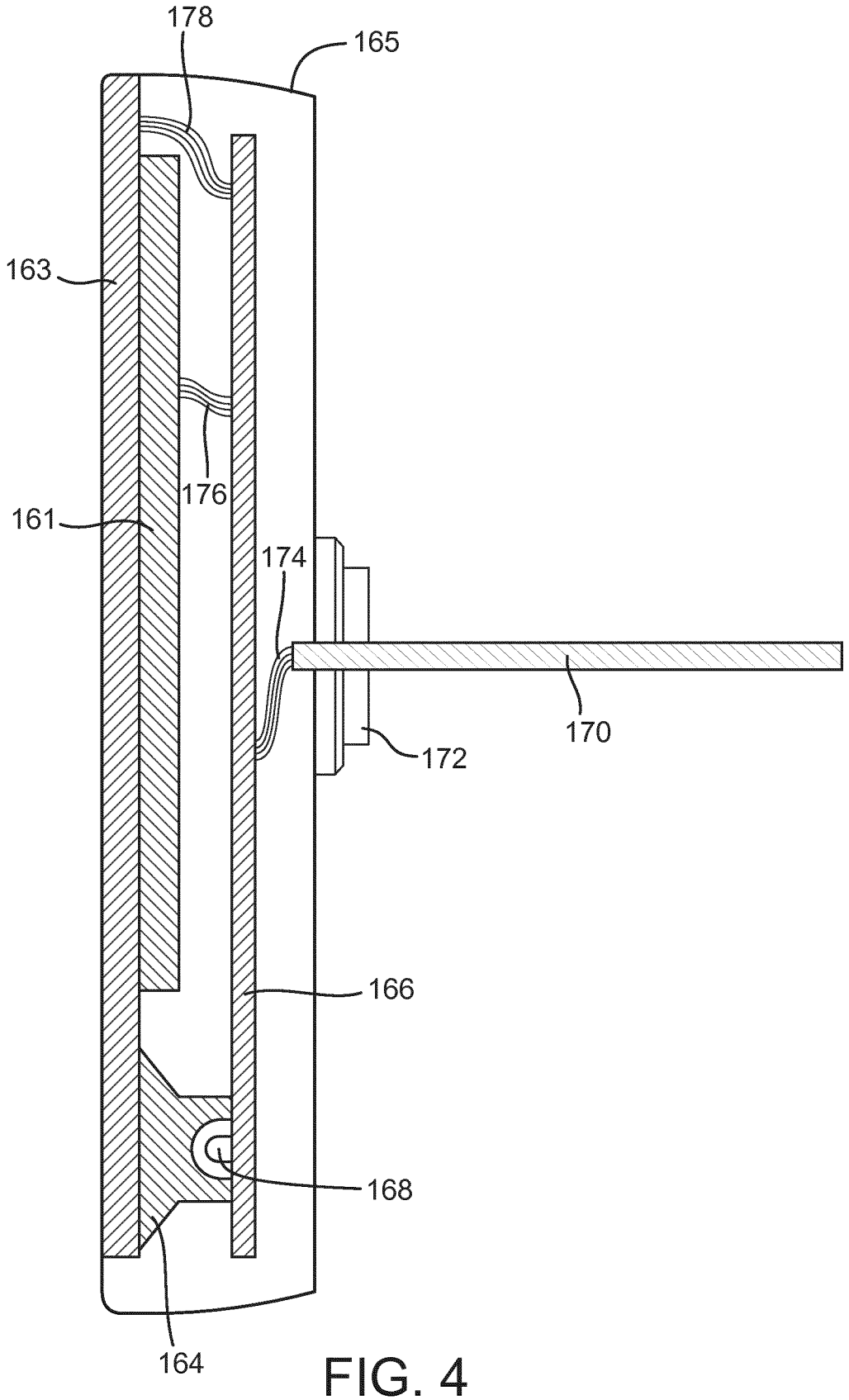
FIG. 4 is a cross-sectional elevation view of the control panel of FIG. 3, according to an exemplary embodiment.

Referring now to FIGS. 3-4, control panel 160 is shown in greater detail, according to an exemplary embodiment. Control panel 160 may be configured to display a graphical user interface via electronic display 161 and to receive user input via a touch-sensitive panel 163 and/or buttons 162. Control panel 160 may include a communications interface (e.g., a wired or wireless interface) for communicating with controller 260 and/or other systems or devices. Control panel 160 may facilitate user interaction with shower control system 200 by receiving and communicating user inputs to controller 260 and displaying information to a user. In various embodiments, controller 260 may be a component of control panel 160 or may be implemented as a separate component.

Control panel 160 is shown to include an electronic display 161. In some embodiments, electronic display 161 is a liquid crystal display (LCD) measuring approximately 7" diagonally. According to other exemplary embodiments, electronic display 161 may use other display technologies particularly suited or adapted for use in a wet environment and may be smaller or larger than 7" (e.g., 5" and smaller, 9" and larger, between 5" and 9", etc.). Display 161 may be positioned behind a touch-sensitive panel 163 and configured to operate as a touchscreen display. For example, electronic display 161 may graphically display information and soft keys (i.e., graphics or icons) configured to be selected by a user or otherwise receive user input. The soft keys may depict, for example, a virtual button, slider, dial, switch, keypad, or other graphic or icon. Control panel 160 may be configured to receive user inputs (e.g., when the user touches or presses one of the soft keys) or performs a gesture relative to touch-sensitive panel 163 (e.g., a swiping motion). In some embodiments, touch-sensitive panel 163 employs resistive touch or capacitive touch-sensitive technology (e.g., capacitive glass). In other embodiments, touch-sensitive panel 163 may use other touch-sensitive technologies as may be applied in wet environments, or may use touch-sensitive technology in combination with hard keys (i.e., physical buttons) located elsewhere on control panel 160.

Control panel 160 is shown to include buttons 162. Buttons 162 may be static buttons which are not part of electronic display 161. Buttons 162 may be represented by fixed-position apertures in an opaque frame around electronic display 161. In some embodiments, buttons 162 are backlit by LEDs 168 or another lighting source positioned within control panel 160. Buttons 162 may be touch-sensitive (e.g., capacitive touch) or a group of hard keys (e.g., physical buttons). In some embodiments, touch-sensitive panel 163 overlays both electronic display 161 and buttons 162. A user interaction with buttons 162 may be detected in the same way that a user interaction is detected with a soft key or other dynamic user interface element of electronic display 161. In some embodiments, control panel 160 can include various other buttons, switches, or other user input devices for receiving user inputs. Such buttons, switches or other user interface devices may be momentary contact switches disposed on a control panel housing 165.

Referring particularly to FIG. 4, control panel 160 is shown to include a control panel housing 165 enclosing touch-sensitive panel 163, electronic display 161, and a circuit board 166. In some embodiments, control panel 160 includes a backlight for electronic display 161. Circuit board 166 may include a processor, memory, and/or various circuit components configured to receive input from touch-sensitive panel 163 (via wires 781) and to provide an output signal to electronic display 161 (via wires 176). Control panel 160 may communicate with external systems or devices via wires 174, which connect to circuit board 166 and pass through a rear surface of housing 165. A seal 170 (e.g., a silicon seal) may surround wires 174 to prevent water from entering housing 165. In some embodiments, one or more sealing strips or sealing layers are provided between various components of control panel 160 to facilitate the water-proof enclosure provided by housing 165. The front surface of control panel 160 may be seamless and impervious to water.

In some embodiments, control panel 160 includes a LED backlight 168 for buttons 162. In some embodiments, a separate LED backlight 168 is provided for each of buttons 162. Light emitted from each LED backlight 168 may be channeled to the front surface of control panel 160 by a light guide 164 (e.g., a light pipe). Advantageously, light guide 164 increase the amount of light visible through buttons 162, thereby providing a high contrast between buttons 162 and the front surface of control panel 160. LED backlights 168 may be separate from any backlight used to provide backlighting for electronic display 161.

As shown in FIG. 4, touch-sensitive panel 163 overlays both electronic display 161 and the light guides 164 that provide lighting for buttons 162. In this configuration, electronic display 161 provides a dynamic display behind a first portion of touch-sensitive panel 163, whereas buttons 162 and light guides 164 provide a static display behind a second portion of touch-sensitive panel 163. Since LED backlights 168 are separate from the backlight for electronic display 161, buttons 162 can illuminate brightly even when electronic display 161 is turned off or in a low power mode. This feature can save power and extend the lifespan of electronic display 161 while still providing touch-sensitive feedback via buttons 162. Since user interactions with buttons 162 are detected in the same manner as user interactions with the dynamic content presented via electronic display 161 (i.e., input received via touch-sensitive panel 163), the front surface of control panel 160 may be implemented as a continuous front panel.

Control panel 160 may be installed within a shower enclosure (as shown in FIG. 1). Housing 165 may include attachment points 172 (e.g., brackets, fasteners, portions for receiving screw heads, etc.) for mounting control panel 160 within shower enclosure 110. Housing 165 also provides a waterproof casing to protect the internal electronic components of control panel 160 from moisture. In various embodiments, the front surface of control panel 160 may be flat with a surface of the shower enclosure (e.g., with housing 165 positioned within the wall) or control panel 160 may be mounted on an existing shower wall (e.g., with a rear surface of housing 165 mounted on the wall).

Referring now to FIGS. 5-24, several graphical user interfaces that may be presented via control panel 160 are shown, according to an exemplary embodiment. The graphical user interfaces illustrate various features, processes, and control options made available to a user by shower control system 200. Computer code modules, instruction sets, or other resources for causing, executing, or facilitating these processes and the related graphical user interfaces may be stored in memory 298 or across memory of the controllers (e.g., control panel 160, controller 260, a controller for subsystems 230-270, etc.).

In some embodiments, the graphical user interfaces presented via control panel 160 display graphical elements for quick and intuitive information recognition and input by the user. For example, the information and soft keys displayed via control panel 160 may be easily distinguished by users with compromised vision (e.g., from steam in shower enclosure 110, moisture on control panel 160, or deteriorated vision). Each soft key displays a graphical user interface element (e.g., an icon) that includes a combination of distinguishing visual features that provide information related to the physical feature associated with the user interface element. For example, each graphical user interface element be indicative of the function of a corresponding physical feature (e.g., water control, lighting, music, steam, etc.). Icons may be grouped in particular areas of the touchscreen interface, may have a particular color, shading, size, background, luminosity, or any combination thereof.

In some embodiments, the graphical elements displayed via electronic display 161 are dynamic elements whereas the graphical elements displayed via buttons 162 are static elements. For example, the graphical elements displayed via electronic display 161 may change based on the display data presented on electronic display 161. Conversely, buttons 162 may be represented by fixed-position apertures in an opaque frame 508 around electronic display 161 and may not change based on the information presented via electronic display 161. Buttons 162 are shown to include a power button 502, a temperature down button 504, and a temperature up button 506. Buttons 162 can be illuminated or non-illuminated by activating or deactivating a corresponding LED backlight 168 behind each button to indicate that the feature associated with the button (e.g., power, temperature up, temperature down) is either available or unavailable.

Figure 5:
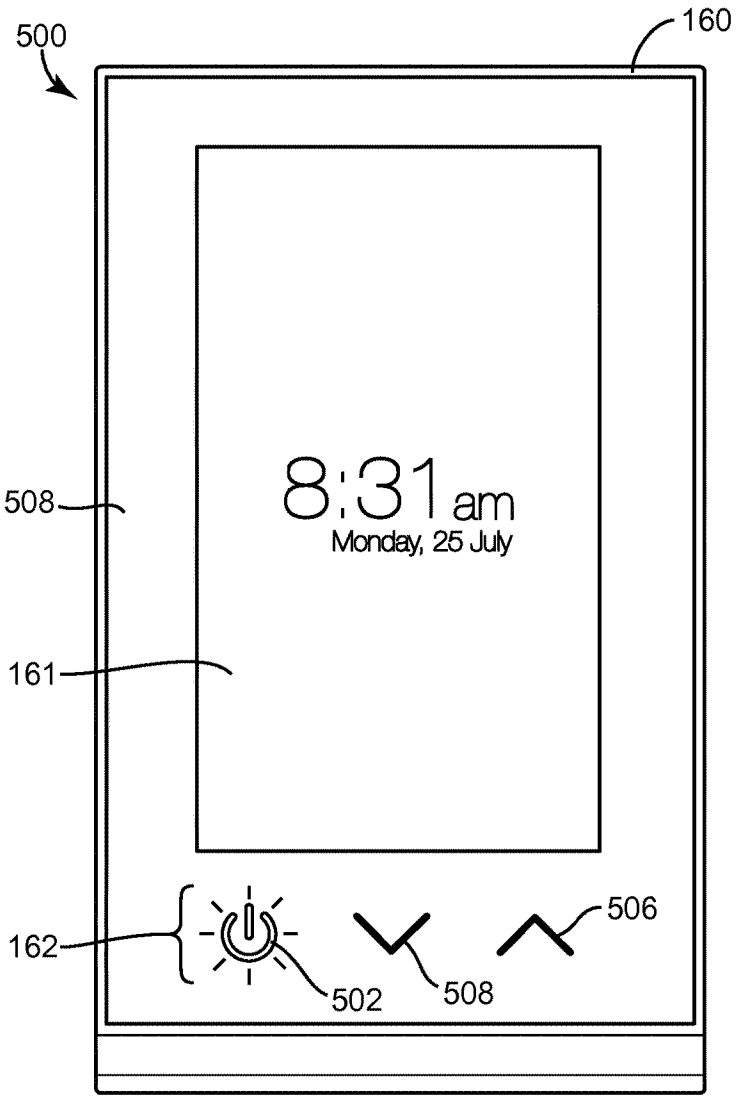
FIG. 5 is a drawing of the control panel of FIG. 3 displaying a power off interface, according to an exemplary embodiment.

Referring particularly to FIG. 5, control panel 160 is shown displaying a "power off" user interface 500, according to an exemplary embodiment. In power off user interface 500, electronic display 161 may display the current time and/or date 510. Buttons 162 are shown with power button 502 illuminated and temperature up button 504 and temperature down button 506 not illuminated. A user can turn on shower control system 200 by pressing power button 502.

Figure 6:
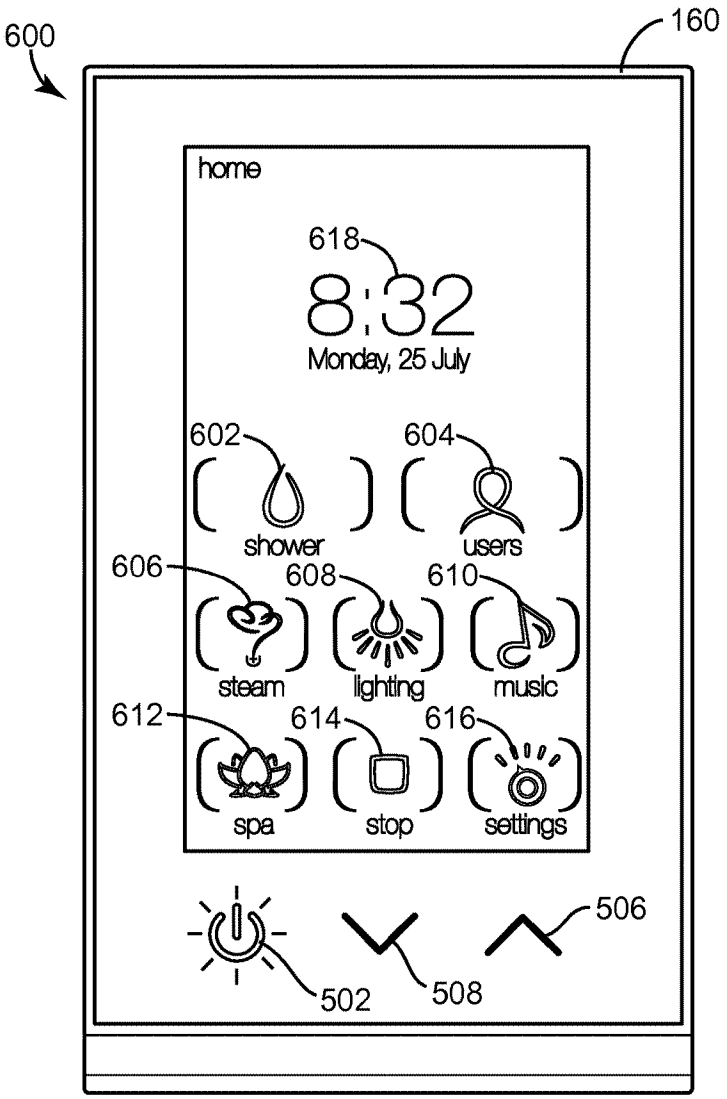
FIG. 6 is a drawing of the control panel of FIG. 3 displaying a home screen interface, according to an exemplary embodiment.

Referring now to FIG. 6, control panel 160 is shown displaying a "home screen" user interface (i.e., home screen 600), according to an exemplary embodiment. Home screen 600 may be displayed in response to pressing power button 502 in power off interface 500. However, this behavior can be changed by setting the startup screen to a different default feature. Home screen 600 is shown to include several graphical elements (i.e., soft keys or icons) displayed on electronic display 161. For example, home screen 600 is shown to include a "shower" element 602, a "users" element 604, a "steam" element 606, a "lighting" element 608, a "music" element 610, a "spa" element 612, a "stop" element 614, and a "settings" element 616. Elements 602-616 may correspond to various program modules or systems that may be selected by the user to display control interfaces for the respective modules or systems. In some embodiments, the elements displayed on home screen 600 can be customized by the user, for example, to display those elements associated with systems or modules most often used.

Home screen 600 may display the current time and/or date 618. If water is not running, the time and/or date 618 may be displayed prominently (shown in FIG. 6). If water is currently running, home screen 600 may display the current temperature of the running water and a target or setpoint water temperature. When water is running, the current temperature and target temperature may be displayed prominently and the current time and/or date 618 may be displayed in a less prominent location (e.g., a corner of electronic display 161). The target water temperature can be adjusted by pressing temperature up button 504 or temperature down button 506. Temperature up button 504 and temperature down button 506 may be illuminated whenever water is running to indicate that the temperature of the running water can be adjusted.

In some embodiments, one or more of graphical elements 602-616 may be omitted from home screen 600 if the corresponding feature is not available for the user's shower configuration. For example, lighting element 608 may be omitted if shower 100 does not include a lighting feature. If fewer features or components are included in shower 100, fewer elements may be displayed on home screen 600. Advantageously, home screen 600 can adapt to multiple different shower configurations by displaying only the user interface elements applicable to a particular shower configuration. Displaying fewer elements on home screen 600 may result in a larger amount of unoccupied space. In some embodiments, the current time 618 or current water temperature is vertically centered in the unoccupied space, regardless of the number of elements displayed.

Referring now to FIGS. 7-13, control panel 160 is shown displaying a "shower control" user interface 700, according to an exemplary embodiment. Shower control interface 700 may be displayed in response to a user selecting "shower" icon 602 on home screen 600. Shower control interface 700 includes a variety of graphical elements for monitoring and/or controlling the water temperature and/or flow volume associated with shower outlets 121-129. For example, shower control interface 700 is shown to include a current water temperature 702 and a target water temperature 704. When water is running, both the current water temperature 702 and the target water temperature 704 may be displayed. Current temperature 702 may be displayed as a larger element than target water temperature 704 when water is running and may be separated from target water temperature 704 by a divider line 706. When water is not running, only the target temperature 704 may be displayed. The display size of target temperature 704 may be larger when water is not running than when water is running.

Figure 9:
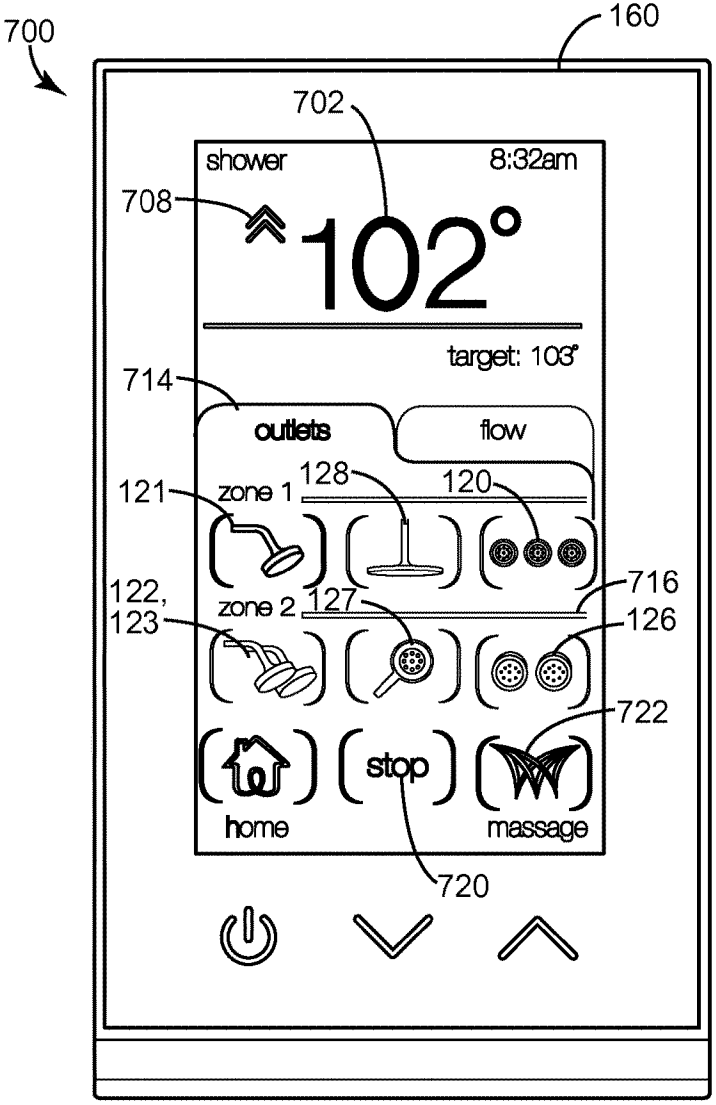
FIG. 9 is a drawing of the control panel of FIG. 3 displaying another shower control interface in which all of the shower outlets are represented as graphical icons in a single tab of the shower control interface, according to an exemplary embodiment.

If the current temperature of the water is increasing, a temperature rising indicator 708 (e.g., a red chevron) may be displayed adjacent to the current temperature 702 (shown in FIG. 9). If the current temperature of the water is decreasing, a temperature dropping indicator (e.g., a blue chevron) may be displayed adjacent to the current temperature 702. The temperature change indicators may blink between dim and bright as the temperature of the water approaches the target value. The temperature change indicators may disappear once the target temperature has been achieved.

When shower control interface 700 is displayed, temperature up button 504 and temperature down button 506 may be illuminated indicating that the target temperature 704 (or temperatures for multi-valve configurations) can be adjusted. Temperature up button 504 and temperature down button 506 may also be illuminated at any time water is running, regardless of which user interface is currently displayed via electronic display 161.

When the target water temperature 704 is adjusted, shower control interface 700 may display a pop-up window 722 (shown in FIG. 10) indicating the change. Pop-up window 722 may prominently display the target water temperature 704 and may be displayed until a predetermined time period (e.g., one second) has passed since the target water temperature 704 has changed. When pop-up window 722 disappears, the target temperature 704 displayed via shower control interface 700 may reflect the new target temperature. For embodiments that include multiple control panels 160, target temperature 704 can be changed from any of the control panels 160. When target temperature 704 is changed from any control panel 160, pop-up window 720 may be displayed on all of the control panels 160 to indicate the target temperature change.

Figure 8:
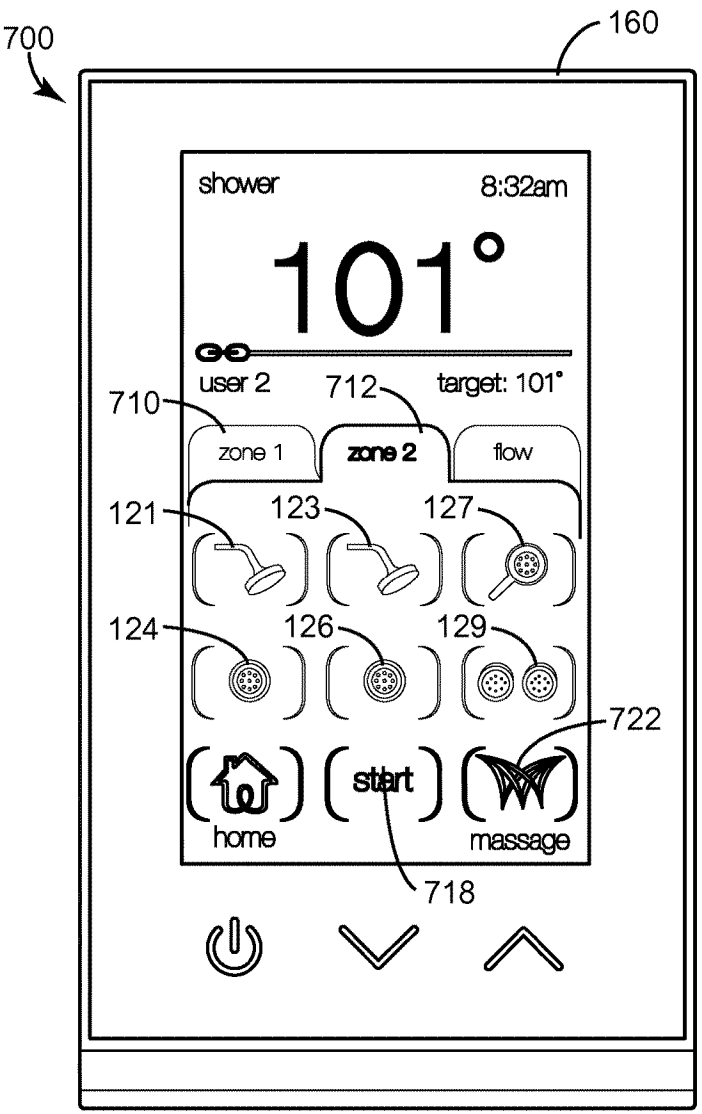
FIG. 8 is another drawing of the shower control interface of FIG. 7 in which another set of shower outlets are represented as graphical icons in a second tab of the shower control interface, according to an exemplary embodiment.
Figure 7:
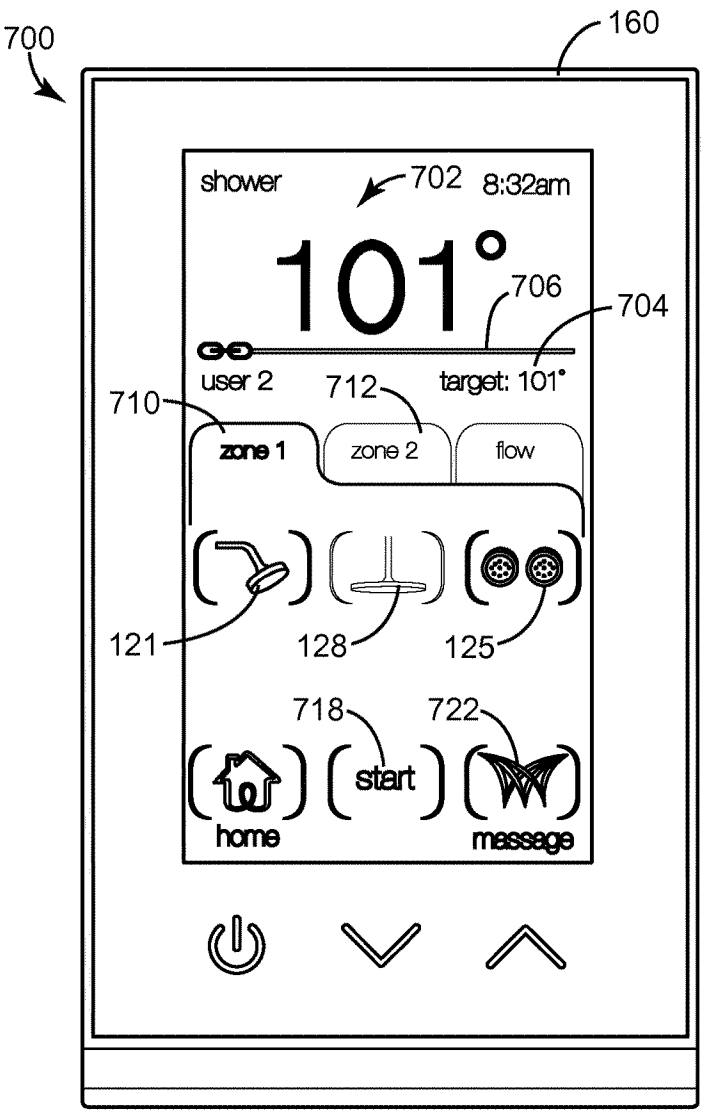
FIG. 7 is a drawing of the control panel of FIG. 3 displaying a shower control interface in which a set of the shower outlets are represented as graphical icons in a first tab of the shower control interface, according to an exemplary embodiment.
Figure 10:
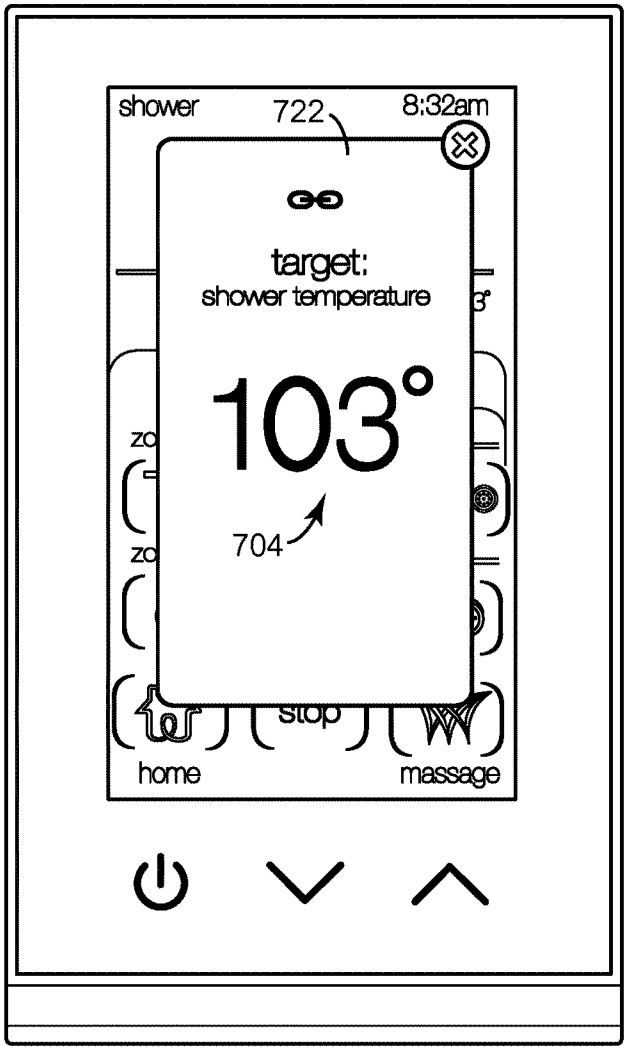
FIG. 10 is a drawing of the control panel of FIG. 3 displaying a temperature adjustment pop-up window, which may be displayed in response to a change in the target water temperature, according to an exemplary embodiment.

Referring particularly to FIGS. 7-9, shower control interface 700 may include graphical elements representing shower outlets 121-129 of the corresponding physical shower 100. The particular graphical elements shown in shower control interface 700 may depend on the number, type, and/or location of shower outlets in shower 100. For example, if shower 100 has multiple temperature control valves, each connected to a subset of shower outlets 121-129, shower control interface 700 may display graphical elements representing shower outlets 121-129 in multiple temperature zones. However, if shower 100 has only a single temperature control valve, shower control interface 700 may display the graphical elements representing shower outlets 121-129 in a single temperature zone.

FIGS. 7-8 illustrate an embodiment of shower control interface 700 for a shower that includes a six-port temperature control valve and a separate three-port valve temperature control valve. Each valve may control water temperature and/or flow to a separate set of shower outlets. In some embodiments, shower control interface 700 includes a "zone 1" tab 710 and a "zone 2" tab 712. Each zone corresponds to a different temperature control valve and may be set to a different temperature. The zone 1 tab 712 is shown to include graphical elements representing front showerhead 121, middle body spray 125, and rainhead 128. The zone 2 tab 714 is shown to include graphical elements representing left showerhead 122, right showerhead 123, upper body spray 124, lower body spray 126, side body sprays 129, and handshower 127. In some embodiments, each zone tab can display a maximum of six shower outlets. The graphical elements may be illuminated (e.g., displayed as white) to indicate that the corresponding shower outlet is active, or not illuminated (e.g., displayed as gray) to indicate that the corresponding shower outlet is inactive. A user can select (e.g., tap or touch) each of the graphical elements to toggle on/off the corresponding shower outlet.

FIG. 9 illustrates an embodiment of shower control interface 700 for a shower than includes two three-port temperature control valves. Each valve may control water temperature and/or flow to a separate set of shower outlets. Each zone corresponds to a different temperature control valve and may be set to a different temperature. In FIG. 9, shower control interface 700 is shown to include a single "outlets" tab 714 which displays multiple temperature zones. Zone 1 is shown to include graphical elements representing front showerhead 121, a central body spray 120, and rainhead 128. Zone 2 is shown to include graphical elements representing lower body spray 126, handshower 127, and a side showerhead element representing both left showerhead 122 and right showerhead 123. Because only six outlet control elements are required, all such elements can be represented on a single outlet control tab 714. Zone 1 may be distinguished from zone 2 by a divider line 716 separating zone 1 outlets from zone 2 outlets.

In various other embodiments of shower 100, shower 100 may include a single six-port temperature control valve or a single three-port temperature control valve. For showers that include only a single temperature control valve, all of the graphical elements representing the available shower outlets may be included in the same temperature zone. Shower control interface 700 may display all of the available shower outlets on a single outlets tab 714 without distinguishing between temperature zones.

In shower control interface 700, any of the graphical elements representing the various shower outlets can be selected or deselected prior to and/or during shower operation. For example, prior to initiating water flow, a user can select or deselect one or more shower outlets by touching the corresponding graphical element in shower control interface 700. When a shower outlet is selected, the corresponding graphical element may be illuminated (e.g., displayed as white) or otherwise marked to indicate the user's selection. The user can then select the "start" element 718 (shown in FIGS. 7-8) to initiate water flow from the selected outlets. While water is flowing, the user can activate or deactivate various shower outlets by selecting the corresponding elements of shower control interface 700. When water begins flowing, start element 718 may change into a "stop" element 720 (shown in FIG. 9). The user can select stop element 720 to stop the flow of water to all shower outlets. Advantageously, shower outlets can be selected and deselected independent of starting and stopping water flow. This feature allows a user to select a combination of shower outlets prior to starting water flow and then select start element 718 to initiate water flow from all of the selected outlets simultaneously.

In some embodiments, controller 260 maintains a first set of state information indicating which of shower outlets 121-129 are selected. Controller 260 may also maintain a second set of state information indicating whether various features provided by shower control system 200 are currently active (e.g., a shower feature, a music feature, a lighting feature, etc.). Controller 260 may use the first set of state information and the second state information to determine whether to use each of shower outlets 121-129 and/or other output devices of shower control system 200 provide an output to shower enclosure 110. For example, controller 260 may activate a shower outlet if the shower outlet is both selected via shower control interface 700 and the shower feature of shower control system 200 is currently active. Multiple shower outlets can be selected or deselected prior to activating the shower feature and then activated simultaneously upon activating the shower feature.

In some embodiments, shower control interface 700 includes a "massage" graphical element 722. Selecting massage element 722 may lead to a pop-up of shower massage sequencing options. The massage sequencing options may include, for example, a shoulder pulse option, a foot pulse option, a single outlet pulse option, and/or a custom pulse option which allows a user to select a combination of shower outlets for use in a massage process. The available massage options may vary depending on the shower configuration. In some embodiments, the available massage options are displayed as radio buttons. The pop-up of massage sequencing options may allow one option to be selected per zone.

Selecting a start element in the pop-up of massage sequencing options may begin the selected massage sequence and toggle the start element to a stop element. If the selected massage sequence requires that more of shower outlets 121-129 be turned on, then the massage sequence may activate any necessary shower outlets. For example, if front showerhead 121 is the only shower outlet that is active prior to beginning the massage sequence and the user selects "shoulder pulse" and "start," the shoulder pulse showerheads (e.g., upper body spray outlets 124) may activate and begin pulsing. Front showerhead 121 may remain active at its pre-massage setting.

Selecting the stop element in the massage pop-up window may stop the massage sequence. If water was running from any of shower outlets 121-129 prior to beginning the massage sequence, selecting the stop element may cause the shower control system to revert to the pre-massage flow configuration. The massage sequence may also be stopped by deactivating the pulsing shower outlets via shower control interface 700. Selecting the stop element 720 via shower control interface may stop water flow from all shower outlets 121-129, regardless of whether the outlets were active prior to the massage sequence.

Figure 12:
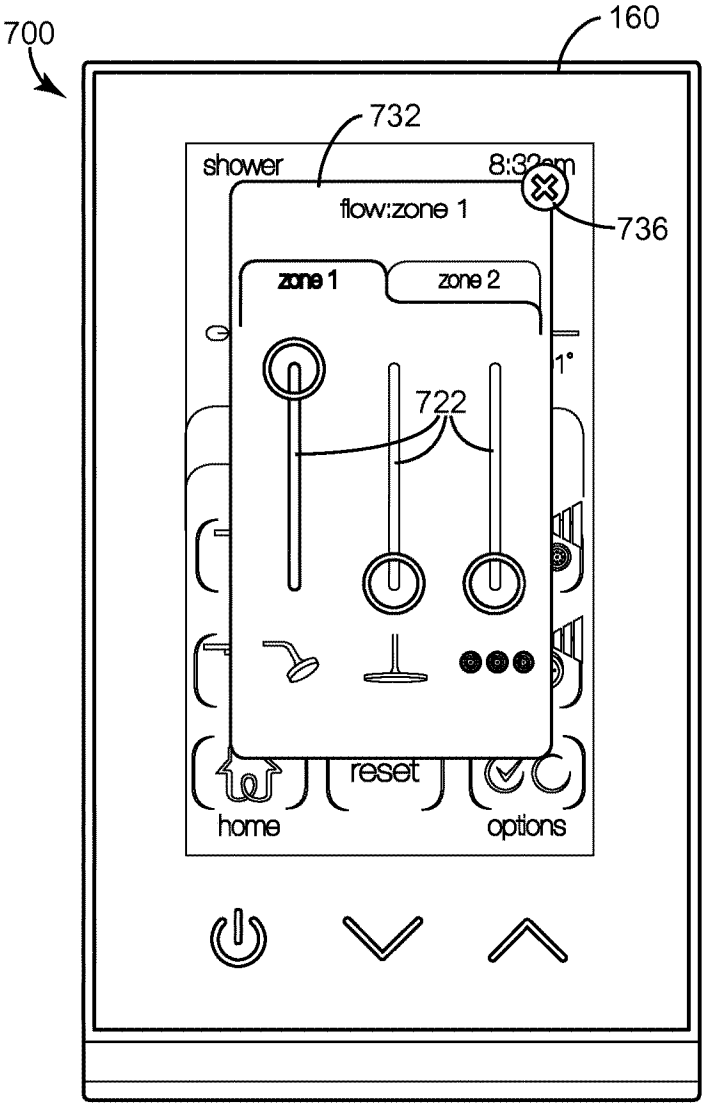
FIG. 12 is a drawing of the control panel of FIG. 3 displaying a flow control pop-up window for fine-tuning the flow volumes associated with the various shower outlets, according to an exemplary embodiment.
Figure 11:
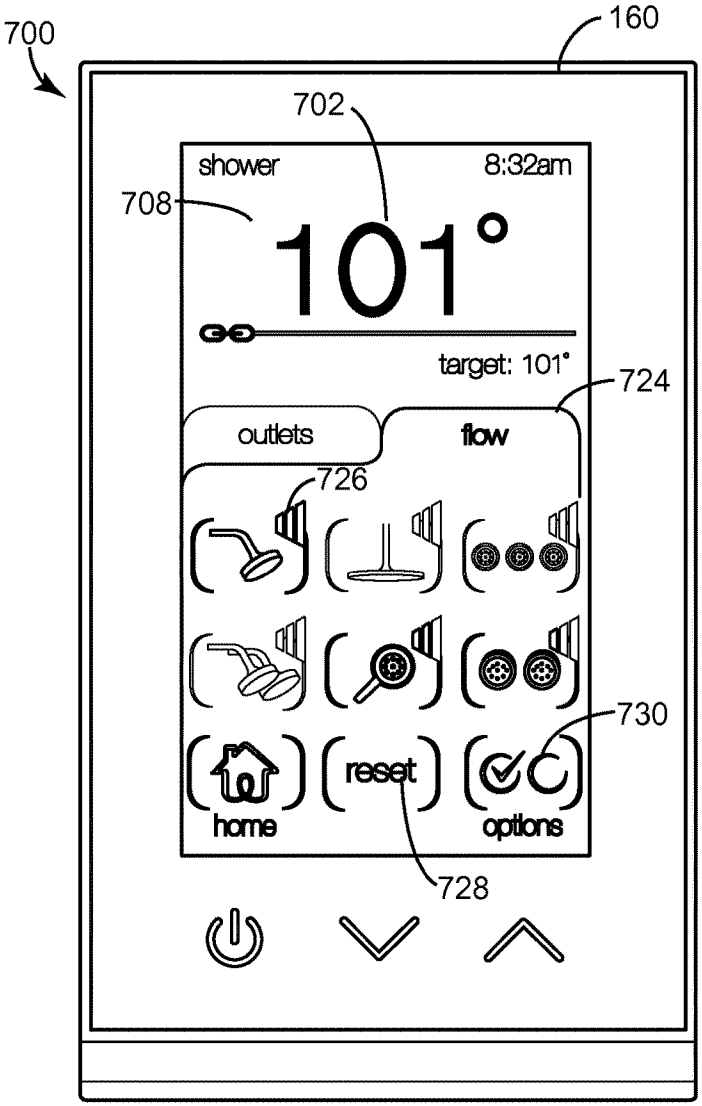
FIG. 11 is another drawing of the shower control interface of FIG. 9 in which flow volumes associated with each of the shower outlets are represented graphically within the shower control interface, according to an exemplary embodiment.

Referring now to FIGS. 11-12, a flow control feature of shower control interface 700 is shown, according to an exemplary embodiment. The flow control feature may be activated by selecting the "flow" tab 724 in shower control interface 700. When flow tab 724 is active, each graphical element representing one or more of shower outlets 121-129 in shower control interface 700 may include a volume indicator icon 726 (e.g., one bar for low flow volume, two bars for medium flow volume, three bars for high flow volume, etc.). When outlets 121-129 are initially activated, they may turn on at a default flow volume. Selecting a graphical element associated with one of shower outlets 121-129 in flow tab 724 may shift the associated flow volume to the next increment and update the corresponding volume indicator icon 726 accordingly. Selecting the reset element 728 may cause all flow volumes to revert to their default values.

Flow tab 724 is shown to include an "options" graphical element 730. Selecting options element 730 may lead to a pop-up flow control window 732 (shown in FIG. 10). Pop-up flow control window 732 may allow a user to adjust flow more precisely relative to the adjustments made via flow tab 724. For example, pop-up flow control window 732 is shown to include sliders 734 that can be set at any point (e.g., one of ten intermediary steps) between minimum volume and maximum volume. Outlets that are currently active or selected may be represented by a bright slider that reflects the flow volume of the corresponding outlet. Outlets that are inactive or not selected may be represented by a dim slider at its at its lowest point. Selecting the "x" icon 736 in the corner of pop-up flow control window 732 may cause shower control interface 700 to revert to flow tab 724 (e.g., without canceling changes made). Updates to flow volumes made via pop-up flow control window 732 may be shown in the flow tab 724. In some embodiments, flow volume adjustment is available for any valve having three ports; however, in other embodiments, flow volume adjustment is available for other types of valves.

Figure 13:
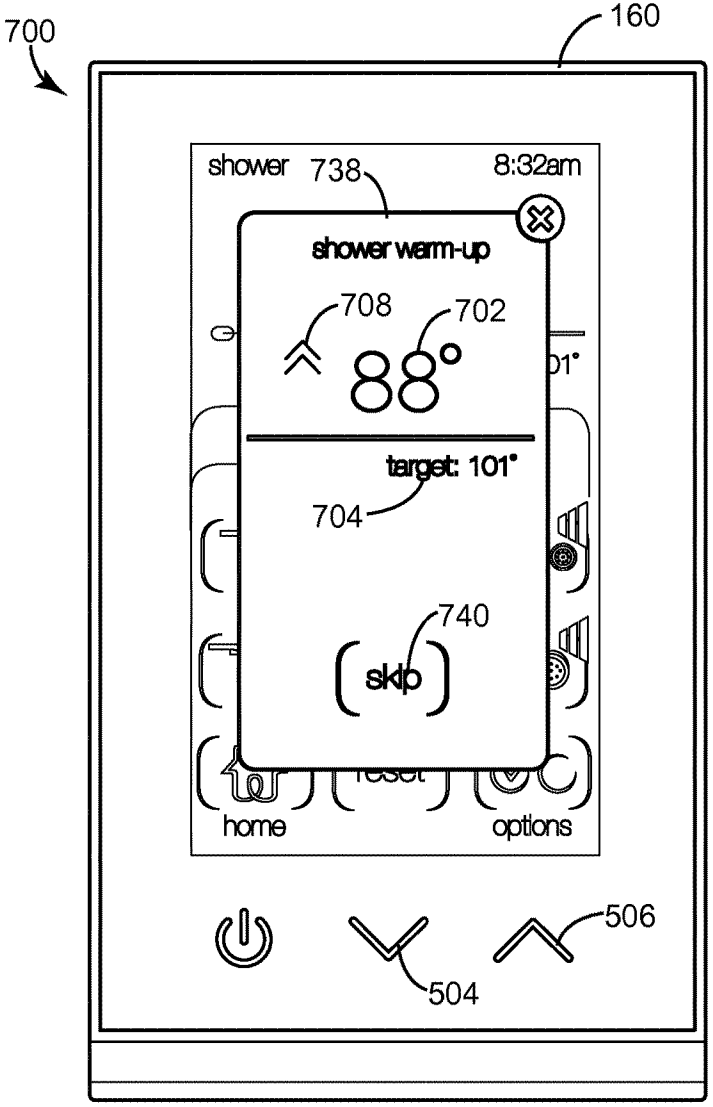
FIG. 13 is a drawing of the control panel of FIG. 3 displaying a shower warm-up pop-up window, which may be displayed while the shower control system is performing a purging operation, according to an exemplary embodiment.

Referring now to FIG. 13, in some embodiments, shower control system 200 includes a purge feature. The purge feature allows shower control system 200 to achieve the target water temperature at an expedited rate by rapidly purging water from the inlet pipes leading into the system. The purge feature may be useful, for example, when shower 100 is initially turned on to purge water that has lost its heat from the hot water inlet line. If the purge feature is enabled, selecting "start" icon 718 in shower control interface 700 may activate all of shower outlets 121-129 until the target temperature is reached.

While the purge process is active, a purge interface 738 may be displayed. Purge interface 738 may include graphical elements indicating current water temperature 702, target water temperature 704, and either a temperature rising indicator 708 or a temperature falling indicator. Target temperature 704 can be adjusted via temperature up button 504 and temperature down button 506 while the purge process is active. Purge interface 738 may include a skip element 740 which cancels the purge process when selected. In some embodiments, if target temperature 704 is not achieved within a predetermined time period after starting the purge process (e.g., twenty minutes), controller 260 automatically cancels the purge process. Upon canceling the purge process (e.g., either automatically or by a user), shower control interface 700 may be displayed.

When the purge process ends (e.g., upon achieving the target temperature or cancelling the purge process) all of shower outlets 121-129 that were not selected prior to selecting start icon 718 may be deactivated. Outlets that were selected prior to selecting start icon 718 may remain active and may maintain target temperature 704. In some embodiments, an indication (e.g., a sound, a display message, etc.) is provided in response to achieving target temperature 704 to inform the user that the target temperature has been reached. When the purge process ends, shower control interface 700 may be displayed. In some embodiments, the purge feature can be enabled or disabled by adjusting the settings of controller 260 (e.g., via a web interface and/or a settings interface). If the purge feature is disabled, selecting start icon 718 may activate only the outlets that were selected prior to selecting start icon 718 without performing the purge process.

Figure 14:
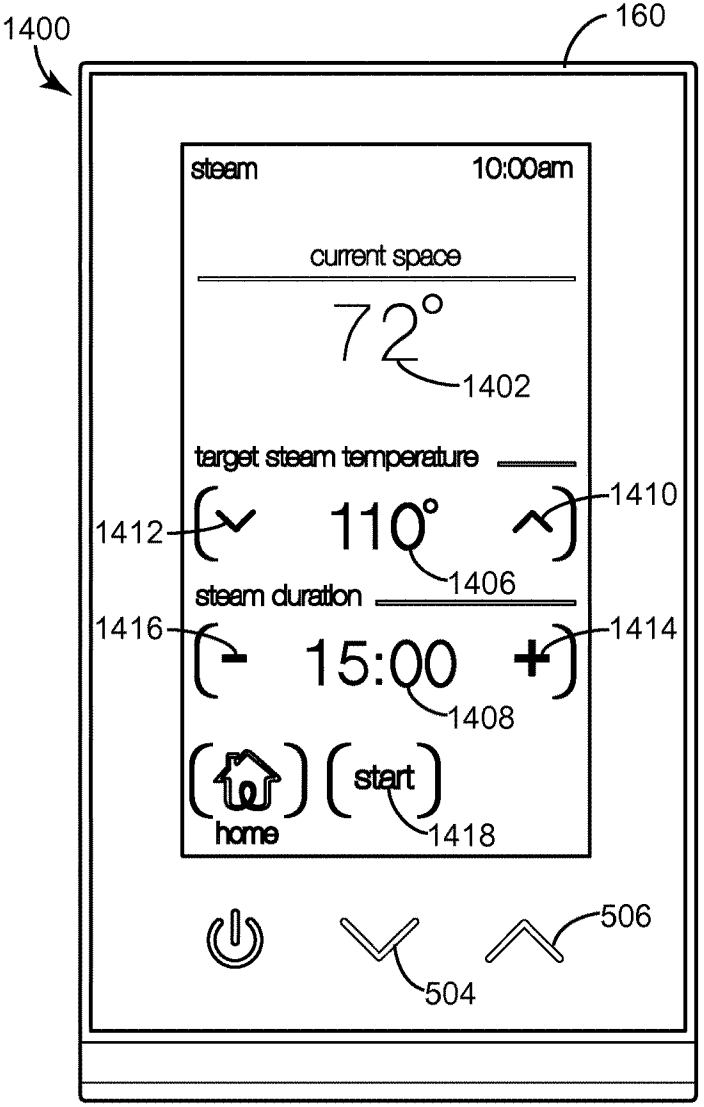
FIG. 14 is a drawing of the control panel of FIG. 3 displaying a steam control interface prior to the shower control system performing a steaming operation, according to an exemplary embodiment.
Figure 15:
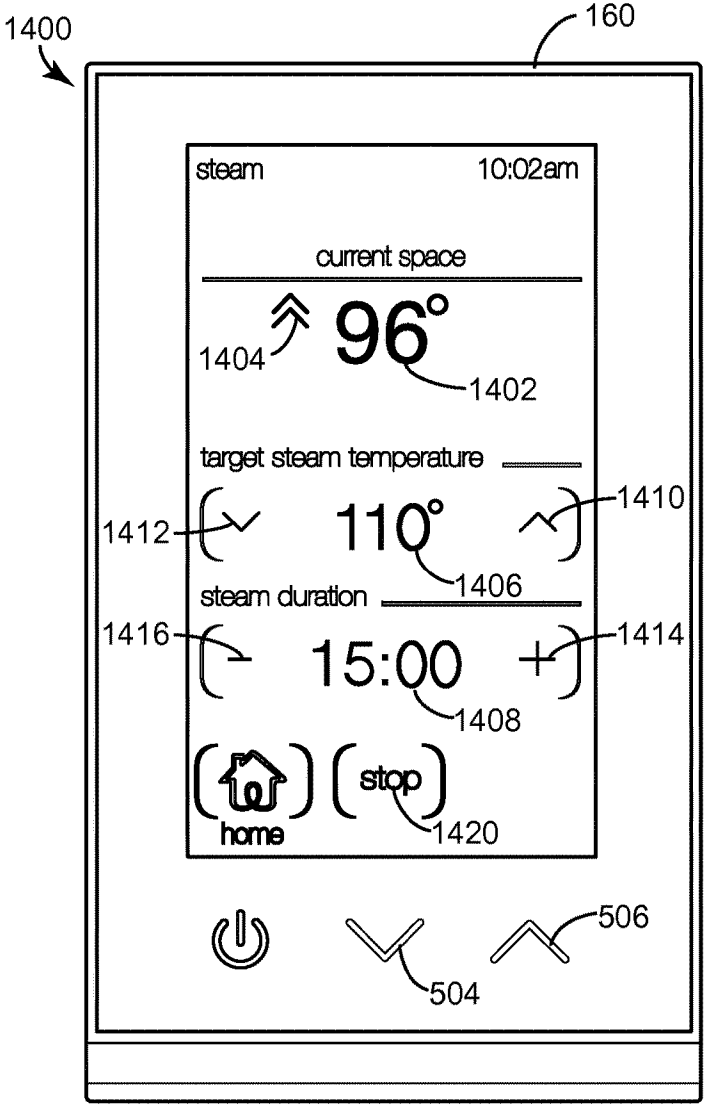
FIG. 15 is a drawing of the steam control interface of FIG. 14 while the shower control system is performing a steaming operation, according to an exemplary embodiment.

Referring now to FIGS. 14-15 a "steam" user interface 1400 is shown, according to an exemplary embodiment. Steam interface 1400 may be displayed in response to selecting steam icon 606 on home screen 600. Steam interface 1400 may provide interface options for monitoring and/or controlling steam system 230. Steam interface 1400 is shown to include a current space temperature indicator 1402. Current space temperature indicator 1402 may display the current temperature of the room or space in which shower 100 is located. If the current temperature of the space is increasing, a temperature rising indicator 1404 (e.g., a red chevron) may be displayed adjacent to current temperature 1402, as shown in FIG. 15. If the current temperature of the space is decreasing, a temperature dropping indicator (e.g., a blue chevron) may be displayed adjacent to current temperature 1402.

Steam interface 1400 is shown to include a target steam temperature indicator 1406 and a steam duration indicator 1408. Target steam temperature indicator 1406 may display the target temperature for steam emitted by steam system 230 from steam outlets 131. The target steam temperature can be adjusted by selecting temperature up arrow 1410 and/or temperature down arrow 1412. Steam duration indicator 1408 may display the duration for which the steam will be emitted from steam outlets 131 at the target steam temperature. The steam duration can be adjusted by selecting plus icon 1414 and/or minus icon 1416. In some embodiments, target steam temperature 1406 may be adjusted by one degree increments and steam duration 1408 may be adjusted by one minute increments. In other embodiments, various other temperature and time increments can be made via steam interface 1400.

Steam interface 1400 is shown to include a start icon 1420. Selecting start icon 1420 may begin the steaming process at the parameters shown. In some embodiments, current space temperature indicator 1402 becomes bright and the adjustable parameters 1406-1408 are dimmed once the steaming process has started (as shown in FIG. 15). Start icon 1420 may also change to a stop icon 1420 when the steaming process is active. The steaming process may cause the temperature of the current space to rise to the target steam temperature. When the current space temperature reaches the target temperature, steam interface 1400 may start a steam duration countdown and an indication (e.g., a beep) may be provided. In some embodiments, the steam duration parameter 1408 can be adjusted during the steaming process. Once the steam duration timer reaches zero, the steaming process may stop. Another indication may be provided when the timer reaches zero and/or shortly before the timer reaches zero (e.g., with one minute remaining).

If water is running while steam interface 1400 is displayed, the water temperature may be displayed on steam interface 1400. Temperature up button 504 and temperature down button 506 can be used to adjust the target water temperature. If either of the temperature control buttons 504-506 is selected, pop-up window 722 may be displayed for a short duration to indicate the adjusted target water temperature.

Figure 16:
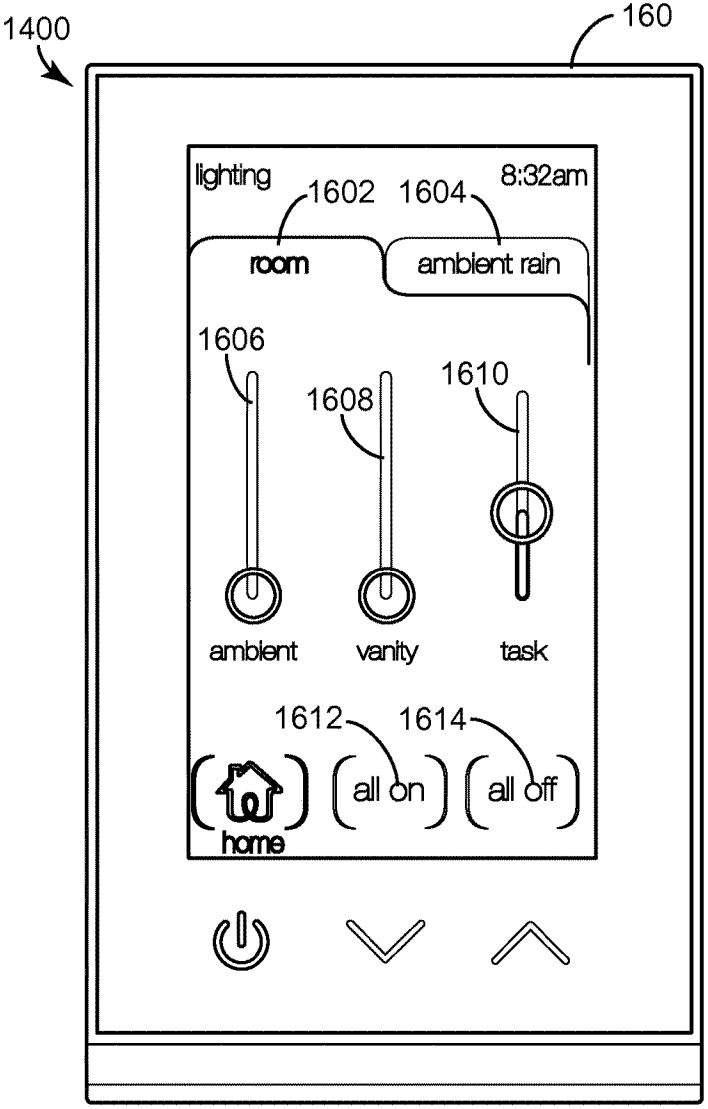
FIG. 16 is a drawing of the control panel of FIG. 3 displaying a lighting control interface in which various sliders representing room lighting fixtures are displayed on a first tab of the lighting control interface, according to an exemplary embodiment.
Figure 18:
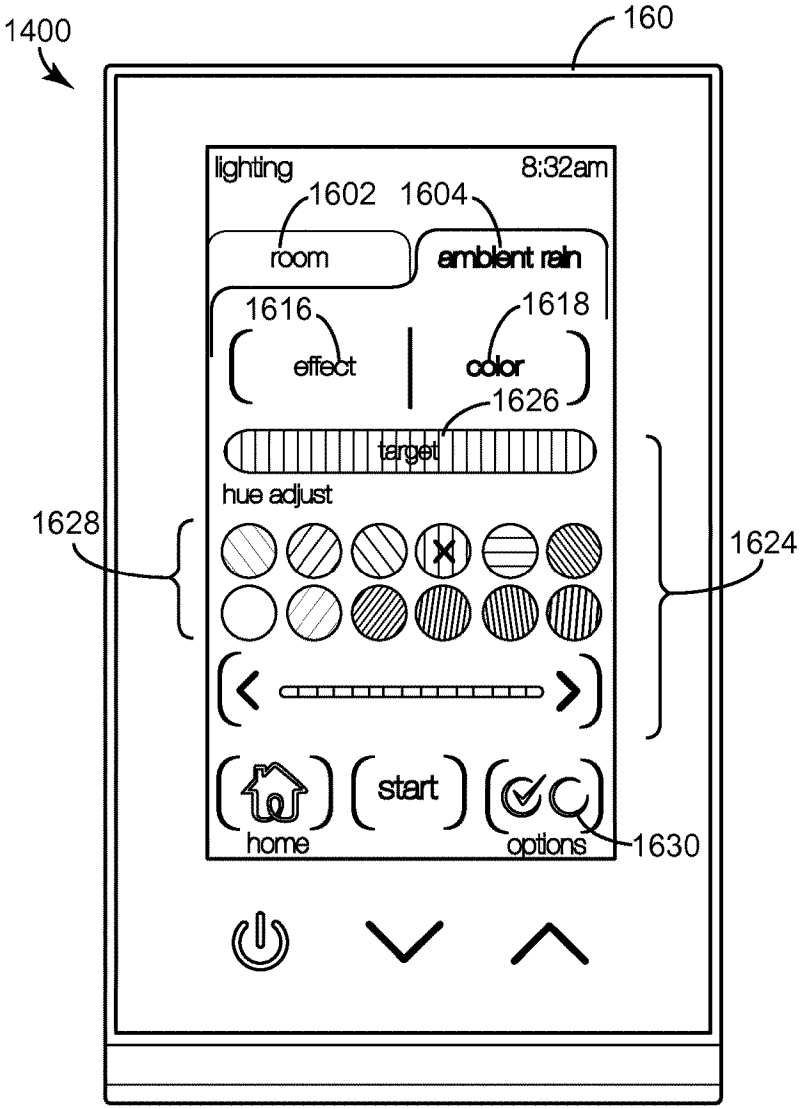
FIG. 18 is a drawing of the lighting control interface of FIG. 16 in which selectable colors for the ambient rain are displayed in the second tab of the lighting control interface, according to an exemplary embodiment.
Figure 17:
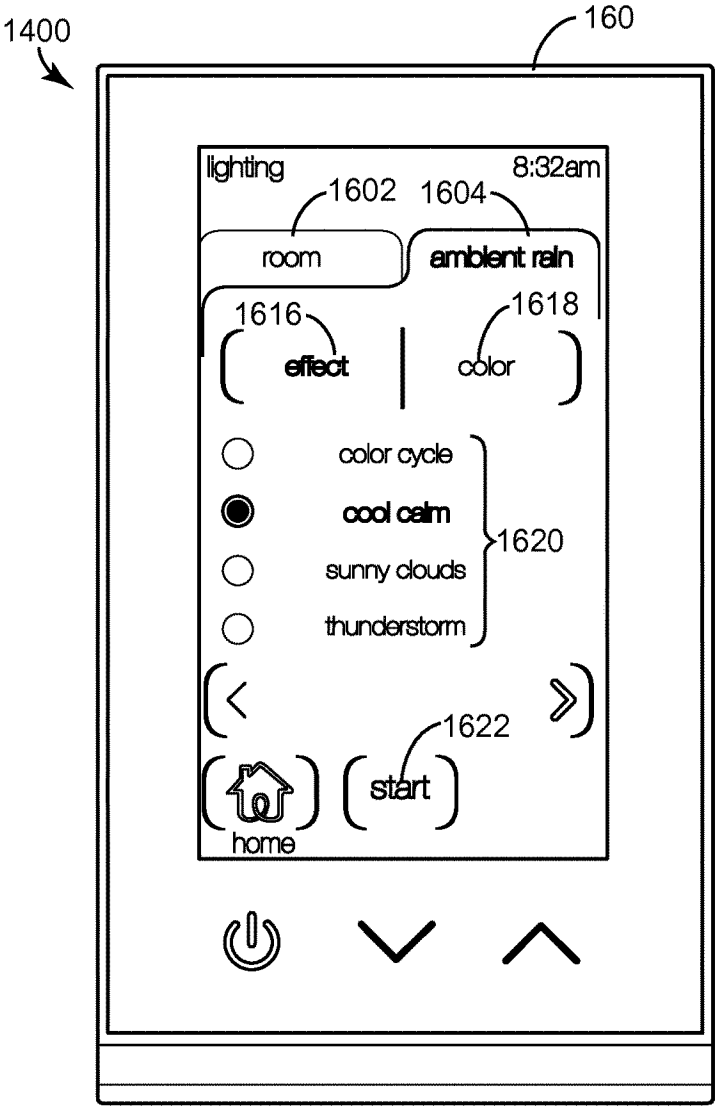
FIG. 17 is a drawing of the lighting control interface of FIG. 16 in which selectable effects for ambient rain lighting are displayed in a second tab of the lighting control interface, according to an exemplary embodiment.

Referring now to FIGS. 16-18, a "lighting" user interface 1600 is shown, according to an exemplary embodiment. Lighting interface 1600 may be displayed in response to selecting lighting icon 608 on home screen 600. Lighting interface 1600 may provide interface options for monitoring and/or controlling lighting for the room in which shower 100 is located (e.g., standard room lighting, chromotherapy lighting, lighting integrated with shower 100, etc.). Shower control system 200 may use input received via lighting interface 1600 to activate or deactivate various lighting elements (e.g., switches, circuits, etc.) or to otherwise control a lighting effect (e.g., color, intensity, etc.). Lighting interface 1600 is shown to include a "room" tab 1602 and an "ambient rain" tab 1604.

Referring particularly to FIG. 16, room tab 1602 may provide interface options for controlling one or more electric fixtures or appliances that can normally be controlled with a switch and/or a dimmer (e.g., incandescent lights, fluorescent lights, LEDs, chromotherapy lights, fans, bathroom appliances, etc.). For example, room tab 1602 is shown to include a plurality of sliders 1606-1610 that can be adjusted between a maximum position and a minimum position. Each slider 1606-1610 may correspond to a particular electric fixture or appliance and can be adjusted to turn on, turn off, or otherwise control (e.g., adjust a light brightness, adjust a fan rotation speed, etc.) the corresponding electric fixture or appliance. For example, ambient light slider 1606 may be used to adjust ambient lighting (e.g., ceiling-mounted or wall-mounted lighting) for the room in which shower 100 is located. Vanity slider 1608 can be used to adjust separate lighting in the room. Task slider 1610 can be used to control a third lighting fixture or another appliance.

Fixtures that are dimmable can be controlled incrementally with sliders 1606-1610. Binary on/off fixtures can be toggled on/off with toggle switches and/or other binary user interface elements. In various embodiments, sliders 1606-1610 may be replaced with switch icons or binary selection icons (e.g., toggle switches) for fixtures or appliances that cannot be controlled incrementally. Selecting the "all on" icon 1612 may move all of sliders 1606-1610 to a maximum position and cause any corresponding lighting fixtures to activate at maximum brightness. Selecting the "all off" icon 1614 may move all of sliders 1606-1610 to a minimum position and cause any corresponding lighting fixtures to turn off Tabs and sliders in lighting interface 1600 can be renamed, added, or removed via a settings interface.

Referring particularly to FIGS. 17-18, ambient rain tab 1604 is shown, according to an exemplary embodiment. Ambient rain tab 1604 may be used to control a color and/or effect of light emitted from a lighting element 151 integrated with rainhead 128. A user can toggle between effect control and color control by selecting either the "effect" icon 1616 or the "color" icon 1618 in ambient rain tab 1604. Effects may be scripted light effects that change color and brightness in sequence. A user can select an effect from a list 1620 of pre-scripted lighting effects displayed in ambient rain tab 1604. Selecting "start" icon 1622 initiates the selected lighting effect and toggles start icon 1622 to a stop icon. When a lighting effect is active, selecting another lighting effect from list 1600 may cause a transition to the newly-selected lighting effect. Effects may be configured to loop until a user selects the stop icon, turns off the lighting feature, or powers off the system.

Selecting the color icon 1618 may cause a color selection interface 1624 to be displayed. Color selection interface 1624 includes a target color 1626 indicating a color that the ambient rain lighting 151 is emitting (i.e., if currently active) or will emit once start icon 1622 is selected (e.g., if currently inactive). Color selection interface 1624 is shown to include various color swatches 1628. Selecting a color swatch 1628 may change target color 1626 to the color of the selected swatch 1628 and cause ambient rain lighting 151 to change to the selected color. Colors in color swatches 1628 may include various shades of white (e.g., soft white, bright white, cool white) and other colors (e.g., red, orange, blue, green, purple, etc.). Selecting the options icon 1630 may cause a brightness slider to be displayed. The brightness slider can be used to control the brightness of ambient rain lighting 151.

Figure 20:
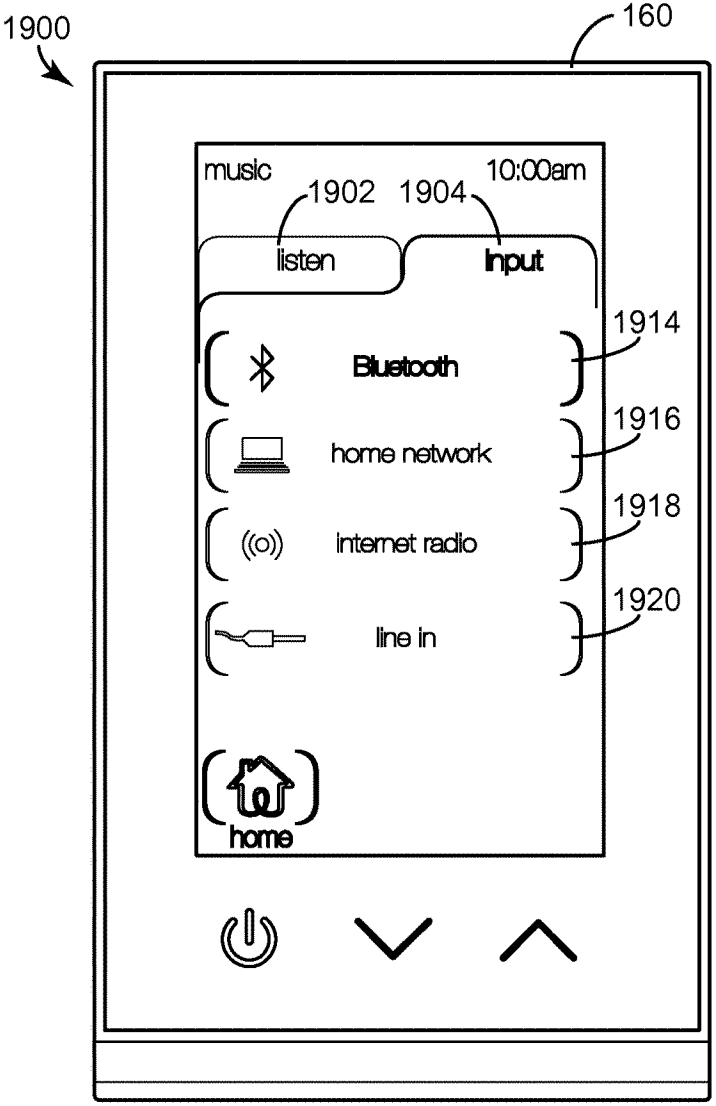
FIG. 20 is a drawing of the audio control interface of FIG. 19 in which various selectable audio input sources are displayed in a second tab of the audio control interface, according to an exemplary embodiment.
Figure 19:
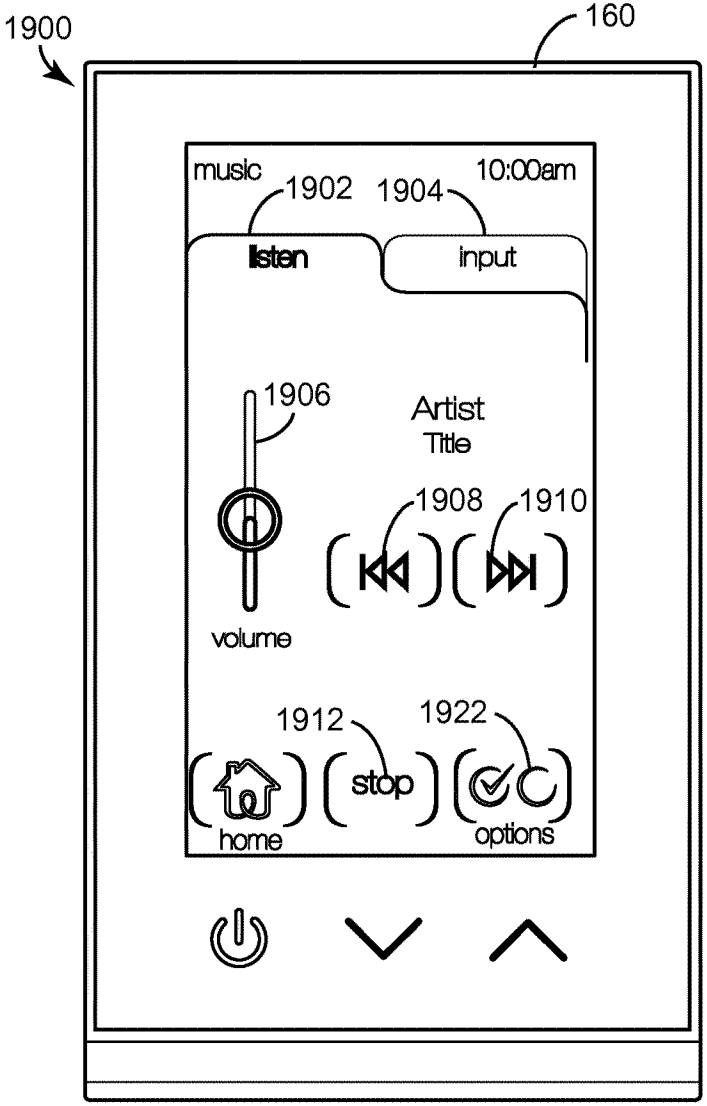
FIG. 19 is a drawing of the control panel of FIG. 3 displaying an audio control interface in which various audio control options are displayed in a first tab of the audio control interface, according to an exemplary embodiment.

Referring now to FIGS. 19-20, control panel 160 is shown displaying an "audio control" user interface 1900, according to an exemplary embodiment. Audio control interface 1900 may be displayed in response to a user selecting the "music" icon 610 via home screen 600. Audio control interface 1900 includes a variety of graphical elements for monitoring and/or controlling audio system 240. For example, audio control interface 1900 is shown to include a "listen" tab 1902 and an "input" tab 1904.

In some embodiments, audio control interface 1900 automatically displays listen tab 1902 when an external device is connected (e.g., via a wireless pairing or via a cable). As shown in FIG. 19, listen tab 1902 is shown to include a volume slider 1906, a previous track icon 1908, and a next track icon 1910. Volume slider 1906 and track icons 1908-1910 can be selected to adjust the volume and/or track of the audio currently playing via audio system 240. Listen tab 1902 may also provide an option pause or stop audio playback (e.g., by selecting stop icon 1912). In some embodiments, listen tab 1902 includes a shuffle icon and a loop icon for indicating whether shuffle and/or loop are active.

Listen tab is shown to include an options icon 1922 which causes an options window to appear when selected. The options window may include various options for adjusting audio playback. For example, the options window may include a bass slider, a treble slider, and a balance slider. A user can manipulate the sliders to adjust the bass, treble, and balance of the audio playback. Adjustments may be reflected in real time. The options window may also include a shuffle icon, a loop icon, and a repeat icon for toggling a shuffle playback mode, a loop playback mode, and a repeat playback mode, respectively.

As shown in FIG. 20, selecting input tab 1904 may cause a list of input connections to be displayed. For example, input tab 1904 is shown to include a Bluetooth icon 1914, a home network icon 1916, an Internet radio icon 1918, and a line in icon 1920. Each of icons 1914-1920 corresponds to a particular input connection available to audio system 240. For example, shower control system 200 may include a wireless transceiver (e.g., WiFi, Bluetooth, NFC, etc.) capable of communicating wirelessly with an external data source. In some embodiments, shower control system 200 includes a Bluetooth-capable transceiver. A user can pair a Bluetooth-capable device (e.g., a smartphone, a portable music player, etc.) with the Bluetooth-capable transceiver to receive audio data from a Bluetooth audio source.

A user can select any of input connection icons 1914-1920 to switch the audio input to the corresponding input connection. For example, selecting Bluetooth icon 1914 may initiate audio playback from a Bluetooth source. The volume of the music may default to approximately 50% when playback is started automatically. When a Bluetooth connection is formed, listen tab 1902 may display artist information and title information for an audio track. In some embodiments, music starts playing automatically when an external device is connected. In various implementations, one or more of input connection icons 1914-1920 may be omitted from input tab 1904 if the corresponding input connection is not available. For example, if shower control system 200 is not connected to a home network, then home network icon 1916 may not be shown.

Selecting the home network icon 1916 may cause a server selection window to appear. The server selection window may include a list of servers available on the home network to which shower control system 200 is connected (e.g., via router 220). The list of servers displayed in the server selection window may be adjusted via a web interface or using the settings configuration options. Selecting a server may cause audio system 240 to connect to the server. Upon connecting to a server, listen tab 1902 may display the artist and title for the most recent audio track from the server played by audio system 240. If playback was from a playlist, the name of the playlist may be displayed. A search interface may be provided to allow a user to locate audio files and/or audio sources available on the home network. When a home network connection is formed, listen tab 1902 may display artist information and title information for an audio track. Listen tab 1902 may also allow the user to pause playback (e.g., by selecting stop icon 1912) or to change the track currently playing (e.g., by selecting previous track icon 1908 or next track icon 1910).

Selecting the Internet radio icon 1918 may cause an Internet radio user interface to be displayed. The Internet radio user interface may include a service selection window which allows the user to select an Internet music service (e.g., Pandora, etc.). Internet radio accounts can be configured via a settings interface. Different users can have different accounts. Selecting an Internet radio service may cause a list of stations to be displayed (e.g., by station name). A station can be selected and music from the selected station can be played via audio system 240. When an Internet radio station is playing, listen tab 1902 may display artist information and title information for an audio track. Listen tab 1902 may also allow the user to pause playback (e.g., by selecting stop icon 1912) or to change the track currently playing (e.g., by selecting previous track icon 1908 or next track icon 1910).

Selecting the line in icon 1920 may cause a line in user interface to be displayed. In some embodiments, the line in user interface allows audio to be played from an external device connected via an auxiliary input (e.g., a data cable, a stereo or mono connection, etc.). The line in user interface may include a volume slider for adjusting the volume of the audio playback from the external device.

Figure 22:
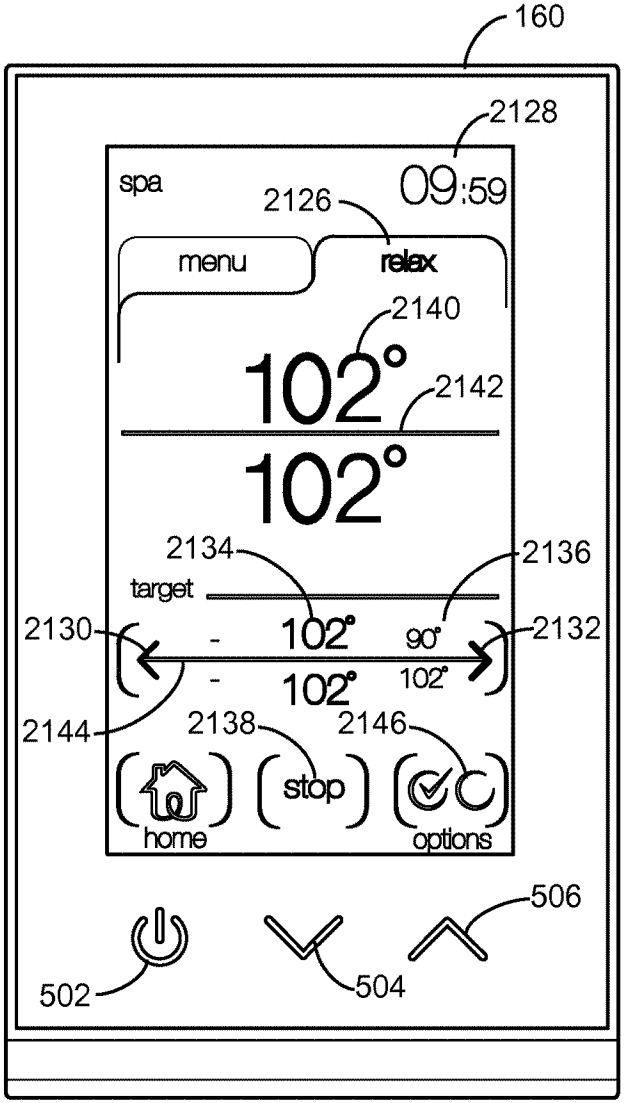
FIG. 22 is a drawing of the spa control interface of FIG. 21 in which a selected spa experience and various control options associated therewith are displayed in a second tab of the spa control interface, according to an exemplary embodiment.
Figure 21:
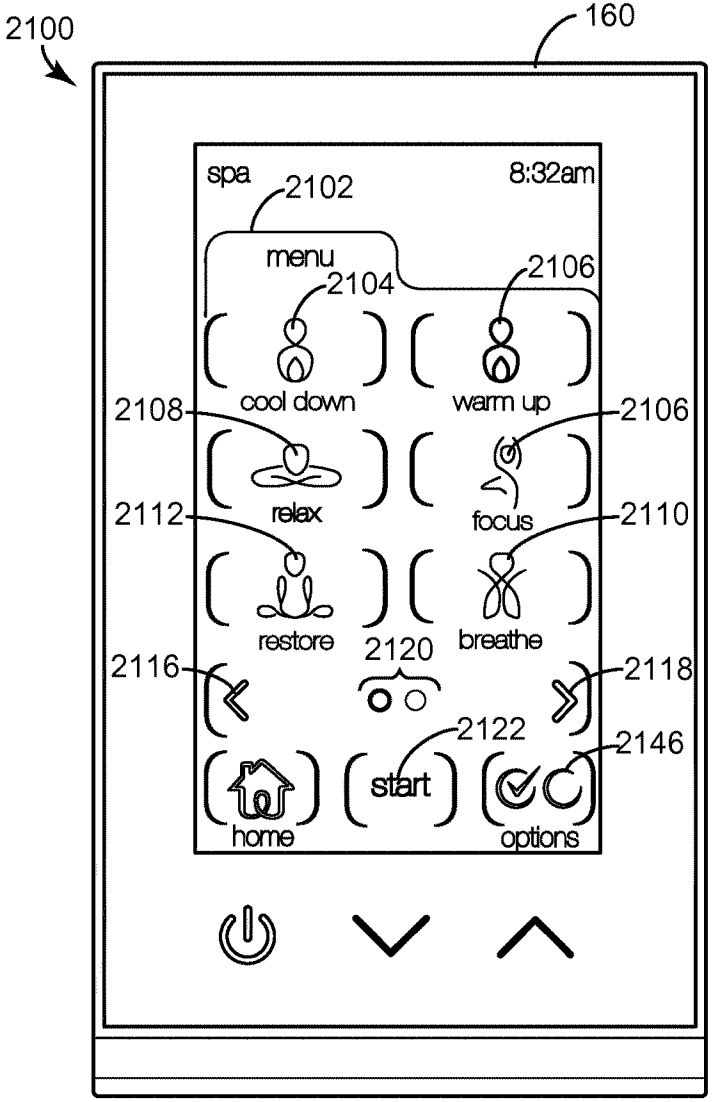
FIG. 21 is a drawing of the control panel of FIG. 3 displaying a spa control interface in which various selectable spa experiences are presented in a first tab of the spa control interface, according to an exemplary embodiment.

Referring now to FIGS. 21-22, control panel 160 is shown displaying a "spa control" user interface 2100, according to an exemplary embodiment. Spa control interface 2100 may be displayed in response to a user selecting "spa" icon 612 on home screen 600. Spa control interface 2100 includes a variety of graphical elements for monitoring and/or controlling various spa experiences provided by shower control system 200. The particular graphical elements shown in spa control interface 2100 may depend on the number, type, and/or location of shower outlets 121-129 and steam outlets 131 in the physical shower 100. For example, shower configurations with a greater number or diversity of shower outlets may have a higher number of water experiences (e.g., eight) available for selection via spa control interface 2100. Shower configurations with a lesser number or diversity of shower outlets may have a lower number of water experiences (e.g., four) available for selection via spa control interface 2100. If the physical shower 2100 includes steam outlets 131, spa control interface 2100 may include one or more steam experiences.

Referring particularly to FIG. 21, spa control interface 2100 is shown to include a "menu" tab 2102. When menu tab 2102 is selected, several graphical elements representing various spa experiences (e.g., water experiences and/or steam experiences) may be displayed. For example, spa control interface 2100 is shown to include graphical elements representing a "cooldown" experience 2104, a "warm up" experience 2106, a "relax" experience 2108, a "focus" experience 2110, a "restore" experience 2112, and a "breathe" experience 2114. Each of the available experiences may correspond to a particular sequence of outputs from shower outlets 121-129 and/or steam outlets 131 (e.g., dispensing water and/or steam from a defined combination of outlets at a particular temperature for a particular duration). Each experience may include multiple stages which are performed sequentially by shower control system 200. Several exemplary spa experiences which may be provided by shower control system 200 are described in detail in U.S. Provisional Patent Application No. 61/934,811, filed Feb. 2, 2014, the entirety of which is incorporated by reference herein.

In some embodiments, not all of the available experiences can be represented simultaneously. For example, if more than a maximum number (e.g., six) of spa experiences are available, any spa experiences in excess of the maximum number may be displayed on a second page. A user can navigate between pages by selecting left arrow 2116 and/or right arrow 2118. The number of circles 2120 located between the arrows 2116-2118 may indicate a number of pages on which various spa experiences are displayed. One of circles 2120 may be highlighted to indicate which page the user is currently viewing. A user can select a spa experience by selecting the corresponding graphical element via spa control interface 2100. In some embodiments, one experience can be selected at a time. For example, if the cool down experience 2104 is selected and the user selects the warm up experience 2106, the warm up icon may become highlighted to indicate that the warm up experience 2106 is currently selected and the cool down icon may return to its non-selected appearance/state.

To begin an experience, the user can select "start" icon 2122. If the purge feature is enabled, selecting start icon 2122 may initiate the purging process, as described with reference to FIG. 13. If the purge feature is enabled, spa control interface 2100 may transition to a spa experience interface 2124 (shown in FIG. 22) once the purging process has completed or has been canceled. If the purge feature is disabled, spa control interface 2100 may transition to spa experience interface 2124 in response to selecting start icon 2122.

Referring particularly to FIG. 22, a spa experience interface 2124 is shown, according to an exemplary embodiment. Spa experience interface 2124 may be displayed in a new spa experience tab 2126. The spa experience tab 2126 may appear when start icon 2122 is selected after selecting a spa experience via spa control interface 2100. Spa experience tab 2126 may be labeled with the name of the selected spa experience (e.g., "relax"). Spa experience interface 2124 is shown to include a temperature indicator 2140 for the temperature of the water currently being output from shower outlets 121-129. If different zones (e.g., zones controlled by different valves) have different temperatures, each temperature may be displayed (e.g., zone 1 on top, zone 2 on the bottom). A dividing line 2142 may separate the zone 1 temperature indicator from the zone 2 temperature indicator.

Spa experience interface 2124 is shown to include a countdown timer 2128 indicating a total amount of time remaining in the currently-active spa experience. In some embodiments, the spa experience includes multiple discrete segments and spa experience interface 2124 includes a segment countdown timer indicating an amount of time remaining in the currently-active segment of the spa experience. When the segment countdown timer reaches zero, the combination of outputs provided by shower control system 200 may change to a different combination of outputs for the next segment of the spa experience Spa experience interface 2124 may be used to skip steps, repeat steps, and/or adjust temperature settings for various steps of a spa experience. In some embodiments, spa experience interface 2124 includes selection arrows (e.g., left arrow 2130 and right arrow 2132) which allow a user to manually transition between segments of the active spa experience. Selecting right arrow 2132 may skip to the next segment, whereas selecting left arrow 2130 may return to the previous segment. If the currently-active segment is the first or last segment, left arrow 2130 or right arrow 2132 (respectively) may be grayed-out to indicate that a transition into the previous or next segment is not available for selection. In some embodiments, selecting left arrow 2130 in the first segment of a spa experience resets timer 2128.

In some embodiments, spa experience tab 2126 shows the target water temperature 2134 for the currently active segment of the spa experience. The target temperature 2136 for the next segment may also be displayed (e.g., between target water temperature 2134 and right arrow 2132). If different zones (e.g., zones controlled by different valves) have different target temperatures, each target temperature may be displayed (e.g., zone 1 on top, zone 2 on the bottom). A dividing line 2144 may separate the zone 1 temperature indicator from the zone 2 temperature indicator.

In some embodiments, the target temperature(s) 2134-2136 for the current spa experience can be adjusted via temperature control buttons 504-506. Selecting one of temperature control buttons 504-506 may cause pop-up temperature adjustment window 722 to appear. In some embodiments, the target temperatures for each zone can be adjusted simultaneously. For example, selecting one of temperature control buttons 504-506 may increase or decrease both target temperatures together such that the temperature differential between zones is maintained. However, if one of the target temperatures reaches a minimum or maximum threshold, the temperature may not be increased or decreased past the threshold. The temperature differential between zones can then be adjusted by moving the other temperature closer to the threshold.

In some embodiments, the spa experience selected via menu tab 2102 may be started automatically in response to selecting start icon 2122. The spa experience may start automatically if the purge process is not performed. In some embodiments, the spa experience does not start automatically if the purge process is performed. A user can then select start icon 2122 on spa experience tab 2126 to start the spa experience. The spa experience may be stopped or paused by selecting stop icon 2138. When stop icon 2138 is selected, stop icon 2138 may toggle to start icon 2122, which can be selected to resume or restart the spa experience. In various embodiments, the spa experience may be resumed from the same segment and/or time at which stop icon 2138 was selected or from the beginning of spa experience.

At the end of a spa experience, all outlets may be deactivated except for the primary shower outlet 121. Shower outlet 121 may continue dispensing water at the ending temperature of the spa experience. Lights and music may continue. A user can select stop icon 2138 or power button 502 to stop the flow of water. In some embodiments, timer 2128 blinks between a bright time and a dim time when the spa experience has ended. The end of a spa experience may be accompanied by an audio indication (e.g., a double beep).

In some embodiments, selecting "options" icon 2146 causes a spa options interface to be displayed. The spa options interface may be presented in a pop-up window and may allow a user to make an adjustment to the selected spa experience. For example, the spa intensity level (e.g., for temperature therapy) can be selected from a list of options (e.g., mild, medium, professional, etc.). The professional level may have greater temperature differentials than the mild and medium levels. For example, a professional level experience may deliver contrast therapy at highest temperature differential (e.g., 18°); the medium level may have a medium temperature differential (e.g., 12°); and the mild level may have a lowest temperature differential (e.g., 6°). The spa options interface may be used to control whether a sound (e.g., a beep) is emitted at the end of each segment and/or at the end of the spa experience.

Figure 23:
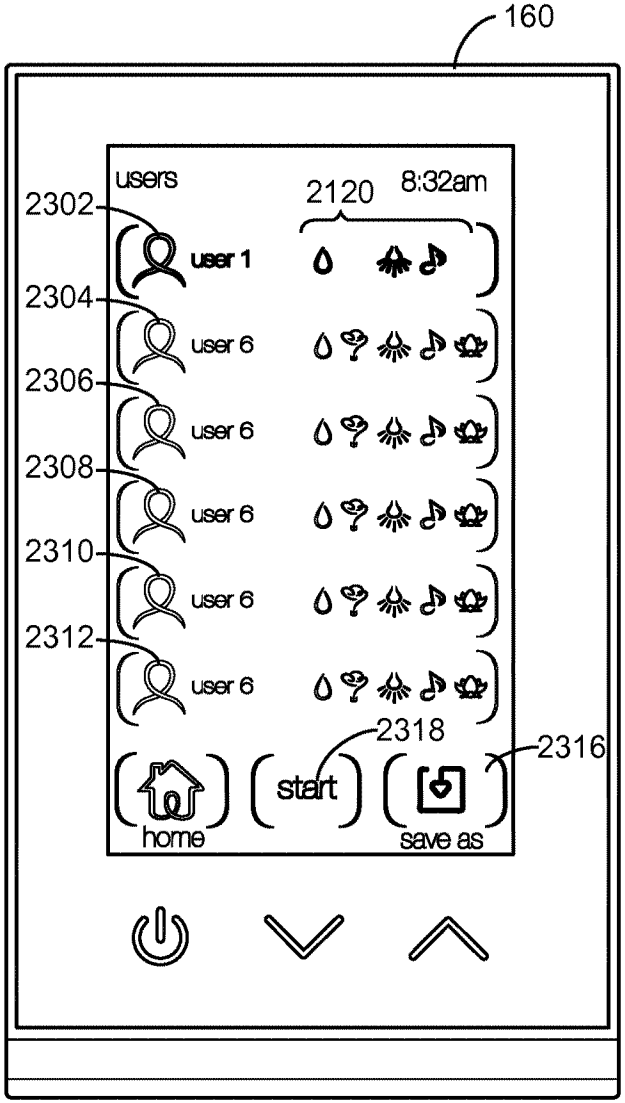
FIG. 23 is a drawing of the control panel of FIG. 3 displaying a user preferences interface, which may be used to store configuration settings to a user profile and retrieve stored configuration settings from a user profile, according to an exemplary embodiment.

Referring now to FIG. 23 a "user preferences" interface 2300 is shown, according to an exemplary embodiment. User preferences interface 2300 may be displayed in response to selecting the users icon 604 on home screen 600. User preferences interface 2300 may provide interface options for configuring user preferences and customization settings for specific users of shower 100. For example, user preferences interface 2300 may allow a user to save a shower configuration by automatically detecting which of the features of shower 100 are currently active and the current settings and/or state of each active feature (e.g., which outlets are on, water temperature, music playlist, light brightness, etc.). Shower control system 200 automatically creates a preset of the active shower configuration and allows the preset to be saved for future retrieval.

User selection interface 2300 is shown to include a listing of several different user profiles 2302-2312. By default, user profiles 2302-2312 may be named chronologically (e.g., user 1, user 2, etc.). However, profiles 2302-2312 can be renamed as desired. The icons 2314 to the right of the profile name represent all the features that may be incorporated into a user profile (e.g., shower, steam, light, music, and spa). A feature may be dimmed, grayed, or omitted if the corresponding user profile has no saved settings for the feature. In FIG. 23, user profiles 2304-2312 are displayed as dimmed or grayed-out to indicate that no settings saved to them. However, user profile 2302 is illuminated to indicate that user profile 3202 has saved settings. The highlighted icons 2314 (i.e., a shower icon, a lighting icon, and a music icon) indicate that user profile 2302 has saved shower settings, saved lighting settings, and saved music settings.

To save a currently-active configuration to a user profile, the user can select the "save as" icon 2316. Selecting icon 2316 may cause a window to be displayed for allowing the user to assign the current configuration to a specific user profile. Upon assigning the configuration settings to a user profile, user interface 2300 may return to home page 600. The name of the user profile to which the settings were just assigned (e.g., "user 1") may be displayed on home page 600.

User selection interface 2300 can also be used to retrieve configuration settings previously assigned to a user profile. Any user profile that has saved configuration settings can be selected via user selection interface 2300. Once a user profile is selected, a user can select start icon 2318 to activate the selected user profile and return to home screen 600. The name of the active user profile may be displayed on home page screen 600.

In some embodiments, user profiles can be selected from user interface 500 by swiping at a designated location of touch-sensitive display 163. For example, a user can swipe from left to right along the top of touch-sensitive display 163 to select user profile 2302 via interface 500. Swiping in different areas and/or directions may select different user profiles. For example, user profile 2312 can be selected from swiping from right to left along the bottom of touch-sensitive display 163.

Figure 24:
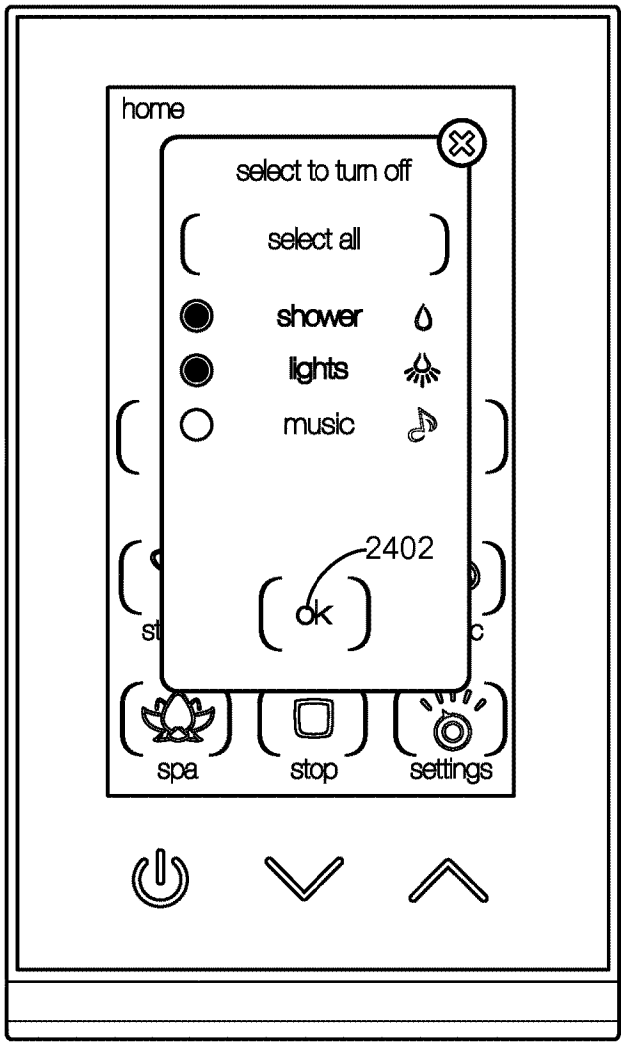
FIG. 24 is a drawing of the control panel of FIG. 3 displaying a feature deactivation interface, which may be used to deactivate various features of the shower control system, according to an exemplary embodiment.

Referring now to FIG. 24, a feature deactivation interface 2400 is shown, according to an exemplary embodiment.

Feature deactivation interface 2400 may be used to deactivate various features and/or subsystems of shower control system 200. In some embodiments, multiple different features of shower control system 200 can be active concurrently. For example, shower control system 200 may concurrently provide a shower feature via valve control system 270, a lighting feature via lighting system 250, a music feature via audio system 240, a steam feature via steam system 230, and/or a spa feature using various combinations of subsystems 230-270. Each feature may run as an independent application or process within the memory of shower control system 200.

In some embodiments, a feature can be stopped by selecting the stop icon within the user interface corresponding to the feature. For example, the shower feature can be stopped by selecting stop icon 720 within shower control interface 700; the steam feature can be stopped by selecting stop icon 1420 within steam control interface 1400; and the music feature can be stopped by selecting stop icon 1912 within music control interface 1900. A feature can also be stopped by selecting the stop icon 614 on home screen 600. For example, selecting stop icon 614 may cause feature deactivation interface 2400 to be displayed. Feature deactivation interface 2400 may include a listing of features that are currently running A user can select one or more features via feature deactivation interface 2400 and select the "OK" icon 2402 to turn off the selected features. Features can also be deactivated via power button 502. For example, selecting power button 502 at any time may stop all currently-active features and display power off interface 500 without displaying the feature deactivation interface 2400.

In some embodiments, controller 260 runs multiple active features of shower control system 200 concurrently and deactivates an active feature of shower control system 200 in response to a user input received via feature deactivation interface 2400. In response to deactivating the active feature, controller 260 may deactivate each of the output devices of shower control system 200 (e.g., shower outlets, lighting elements, speakers, steam outlets, etc.) that are used only in the deactivated feature. Controller 260 may continue to operate each of the output devices that are used in any remaining active features of shower control system 200 in accordance with the remaining active features.

In some embodiments, shower control system 200 includes various features in addition to the features explicitly described herein. For example, shower control system 200 may include any of the features or components disclosed in U.S. Provisional Patent Application No. 61/934,811, filed Feb. 2, 2014, the entirety of which is incorporated by reference herein. Exemplary features may include, for example, a timer/alarm feature, an automatic tub filling feature, a settings feature for adjusting various setting of shower control system 200 (e.g., feature settings, date and time settings, units settings, language settings, control panel settings, display settings, startup settings, etc.), or any other feature that can be incorporated into shower control system 200, as would be appreciated by one of ordinary skill in the art.

It is important to note that the construction and arrangement of the shower control system as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The present disclosure contemplates methods, systems and program products on memory or other machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products or memory including machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A shower control system for a plurality of output devices comprising a plurality of shower outlets located within a shower enclosure, the shower control system comprising:

a controller in communication with the plurality of output devices and configured to control the plurality of output devices to provide multiple features of the shower control system;

a control panel in communication with the controller and configured to present a graphical user interface that allows a user to select or deselect each of the output devices and activate or deactivate each feature by selecting corresponding icons of the graphical user interface;

wherein the controller is configured to:

receive a user input selecting a new feature of the shower control system for activation;

in response to the user input selecting the new feature for activation and prior to activating the new feature, perform a purge process comprising temporarily dispensing water from all of the shower outlets until a temperature of the water dispensed from the shower outlets reaches a threshold temperature; and in response to the temperature of the water dispensed from the shower outlets reaching the threshold temperature, automatically activate the new feature and stop dispensing the water from any of the shower outlets not selected prior to selecting the new feature for activation.

2. The shower control system of claim 1, wherein the control panel is configured to provide a graphical user interface for controlling the multiple features of the shower control system, the graphical user interface comprising a plurality of selectable icons representing the plurality of output devices;

wherein the controller is configured to receive a user selection of one or more of the output devices via the graphical user interface and to update first state information based on which of the output devices are selected via the graphical user interface.

3. The shower control system of claim 1, wherein the control panel is configured to provide a graphical user interface for activating or deactivating the multiple features of the shower control system;

wherein the controller is configured to activate or deactivate the multiple features of the shower control system and to update second state information based on a user input received via the graphical user interface.

4. The shower control system of claim 1, wherein determining whether to use an output device to provide an output to the shower enclosure comprises:

using first state information to determine whether the output device is selected;

using second state information to determine whether the output device is used in an active feature; and in response to a determination that the output device is both selected and used in an active feature, using the output device to provide an output to the shower enclosure in accordance with the active feature.

5. The shower control system of claim 1, wherein the controller is configured to:

receive a user input indicating the selected output devices prior to activating any of the selected output devices; and activate all of the selected output devices simultaneously upon activating a feature of the shower control system that uses all of the selected output devices.

6. A shower control system for a plurality of output devices located within a shower enclosure, the shower control system comprising:

a controller in communication with the plurality of output and configured to control the plurality of output devices to provide a predetermined sequence of outputs from the plurality of output devices, the predetermined sequence of outputs defining a spa experience; and a control panel in communication with the controller and configured to provide a graphical user interface for controlling the spa experience, the graphical user interface comprising selectable options for adjusting a parameter of the spa experience while the plurality of output devices are providing the spa experience;

wherein the spa experience comprises multiple timed segments arranged in a playback sequence, each of the segments comprising a different combination of outputs from the plurality of output devices, and the controller is configured to playback the spa experience by operating the plurality of output devices to sequentially provide each combination of outputs in the playback sequence; and wherein the selectable options for adjusting a parameter of the spa experience comprise options for advancing to a next timed segment of the spa experience and returning to a previous timed segment of the spa experience during playback of the spa experience, wherein the options for advancing to the next timed segment and returning to the previous timed segment cause the controller to skip or repeat one or more of the timed segments of the spa experience without modifying any of the timed segments.

7. The shower control system of claim 6, wherein the selectable options for adjusting a parameter of the spa experience comprise options for adjusting a target temperature of water output by the plurality of output devices during a segment of the spa experience.

8. The shower control system of claim 6, wherein the graphical user interface is configured to display a pop-up temperature adjustment window in response to receiving a user input changing a target temperature of water output by the plurality of output devices.

9. The shower control system of claim 6, wherein the graphical user interface is configured to display:

a temperature rising indicator when a temperature of water output by the plurality of output devices is increasing toward a target temperature; and a temperature failing indicator when the temperature of water output by the plurality of output devices is decreasing toward the target temperature.

* * * * *